US008544114B2

(12) United States Patent
Williams et al.

(10) Patent No.: US 8,544,114 B2
(45) Date of Patent: Oct. 1, 2013

(54) EXERCISE SUIT

(76) Inventors: Dexter Williams, Hillsborough, NJ (US); Derrick Johnson, Santee, SC (US); Gregory Moore, Atlanta, GA (US)

( * ) Notice: Subject to any disclaimer, the term of this patent is extended or adjusted under 35 U.S.C. 154(b) by 89 days.

(21) Appl. No.: 13/034,240

(22) Filed: Feb. 24, 2011

(65) Prior Publication Data

US 2011/0209264 A1 Sep. 1, 2011

Related U.S. Application Data

(60) Provisional application No. 61/308,345, filed on Feb. 26, 2010.

(51) Int. Cl.
*A41D 13/00* (2006.01)

(52) U.S. Cl.
USPC ..... 2/69; 2/227; 2/79; 462/121; 462/124

(58) Field of Classification Search
USPC ..... 2/69, 70, 79, 227, 239, 80, 409, 115, 2/102, 233, 22, 228, 238, 108, 244; 482/124, 482/121, 105, 131, 74; 24/306
See application file for complete search history.

(56) References Cited

U.S. PATENT DOCUMENTS

| | | | | |
|---|---|---|---|---|
| 4,065,814 | A | 1/1978 | Fox | |
| 4,910,802 | A | 3/1990 | Malloy | |
| 5,109,546 | A | 5/1992 | Dicker | |
| 5,186,701 | A | 2/1993 | Wilkinson | |
| 5,306,222 | A | 4/1994 | Wilkinson | |
| 5,308,305 | A | 5/1994 | Romney | |
| 5,708,976 | A | 1/1998 | Dicker | |
| 2005/0255975 | A1 * | 11/2005 | Horn et al. | 482/124 |
| 2009/0151038 | A1 * | 6/2009 | Muench | 2/23 |

* cited by examiner

*Primary Examiner* — Danny Worrell
*Assistant Examiner* — Khaled Annis
(74) *Attorney, Agent, or Firm* — Sand & Sebolt

(57) ABSTRACT

An exercise suit which includes a resilient band extending through a guide pocket in a first direction along a pant leg or sleeve of the suit. The band engages a direction changing means near the end of the leg or sleeve and at least a portion of the band extends there beyond in a second direction. A free end of the band is releasably engaged with a tension adjustment mechanism provided on the exterior of the leg or sleeve a distance away from the direction changing means. The wearer adjusts the tension in the band by moving a length of the band through the direction changing means and repositioning the free end on the tension adjustment mechanism. A cover is removably disposed over the tension adjustment mechanism to prevent accidental dislodgement of the free end of the band.

20 Claims, 13 Drawing Sheets

EXERCISE SUIT

CROSS REFERENCE TO RELATED APPLICATION

This application claims priority from U.S. Provisional Application Ser. No. 61/308,345 filed Feb. 26, 2010; the disclosure of which is incorporated herein by reference.

BACKGROUND OF THE INVENTION

1. Technical Field

The invention relates generally to exercise equipment and apparel worn during fitness activities. More particularly, the invention relates to a suit worn while exercising which provides additional resistance for a more intense workout. Specifically, the invention relates to an exercise suit that has at least one resilient band which extends along one of the pant legs or sleeves, is passed through a direction changing means, is releasably engaged with a tension adjustment mechanism and covered by a cover. The resilient band is situated so that it is readily and easily adjusted before the suit is put on, when the suit is being worn and while the wearer is actively exercising.

2. Background Information

Exercise and fitness equipment is a major industry including exercise apparel and devices to encourage and facilitate healthy lives. Exercise apparel includes team related merchandise as well as moisture-wicking and heat retaining apparel. Still further, exercise apparel can also be used to stimulate and increase the intensity of an exercise. Exercise suits are prime examples of exercise apparel that can increase the intensity of a workout.

A number of exercise suits have been proposed in the prior art for aiding people in increasing the intensity of their workout. An example of such a suit is that disclosed in U.S. Pat. No. 4,065,814 to Fox. The suit is designed to cover the user's whole body. The suit is made up of an inner layer and an outer layer of fabric and includes a number of elastic bands that are disposed between these layers. A first elastic band is provided around the waist region of the suit. A pair of substantially parallel, spaced apart elastic bands is fixed adjacent the front of an ankle region on each pant leg 56, extend upwardly along the front of the suit, over the shoulder region and downwardly along the back of the suit, and are fixed adjacent the back of the ankle region of each pant leg 56. An elastic triangular region is also provided to extend beneath the user's feet. The elastic bands are placed under tension when the suit is put on and thereby apply positive pressure to the legs, back and shoulders of the user. The elastic bands are not adjustable to change the tension applied to the user's body.

A second exercise suit disclosed in the prior art is found in U.S. Pat. No. 4,910,802 to Malloy. Again, this suit is a one piece suit that is designed to cover the entire body. A number of elastic bands are utilized in the suit. A pair of substantially parallel elastic bands is provided in each sleeve and leg. One of the pair extends down the interior side region of each sleeve and each leg and the other of the pair extends down the exterior side region of each sleeve and each leg. In the sleeves, those bands are disposed in conduits that extend from the shoulder region to the wrist region. In the legs, those bands extend from the waist region to the ankle region. Additional bands extend horizontally around the chest and the waist regions of the suit. Each band s positioned within an enclosed conduit on the exterior surface of the suit and the conduits each include an access region. Buckles are provided on the bands in these access regions to permit the user to adjust the tension in the bands. The sleeve sections each include a fingerless glove and the leg sections each include a sock portion to maintain the orientation of the suit on the user's body.

U.S. Pat. No. 5,109,546 to Dicker discloses an elastic exercise suit that is made of a separate pant section and top. The top has a stretchable reinforcing collar and includes reinforcing bands that extend from the collar to the waist opening. The pants include a reinforced waist region and a reinforcing band that is fixedly secured to one side of the waist region, winds helically around a first pant leg 56, extends under a foot opening and back up along that first leg, along the crotch region, winds helically around a second pant leg 56, under the foot opening and back up along the second leg, finally being fixedly secured to the other side of the waist region. All of the reinforcing regions, i.e., the collar, top side bands, pant waist region and helical leg band are all made from an elastic fabric that is sewn into the rest of the elastic suit but differs therefrom. The elastic fabric used to make the reinforcing panels is more difficult to stretch than the surrounding fabric and these panels therefore require extra effort on the part of the user to exercise in the suit. The reinforced waist region also includes hook and loop tape that allows the user to adjust the tension in the waist region. Similarly, a length of hook and loop fastener is secured to portions of a reinforcing knee pad. The hook and loop fastener is threaded through one of a plurality of loops to adjust the tension in the knee pad. The adjustment of the knee pad somewhat increases or decreases the tension in the reinforcing leg band.

U.S. Pat. Nos. 5,186,701 and 5,306,222 to Wilkinson disclose an exercise outfit that includes a one-piece exercise suit that has anchors at its limb extremities, such as the gloves or loops on the hands and boots or loops on the feet. Other anchors are provided at other locations such as at the shoulders and the middle of the chest and back. Elastic resistance bands are connected between these various anchors and may be passed through guide pockets provided on the suit. The suit enables the user to position the resistance cords over the suit, attached to the suit or threaded through the suit. In one embodiment of the suit, the resistance cords are passed through channels and are secured to the anchors at the limb extremities.

U.S. Pat. No. 5,308,305 to Romney discloses close-fitting exercise apparel that includes several passageways on its exterior surface. A resistance member is able to be threaded through each passageway and is releasably secured at either end to a belt or harness by way of a suitable means such as a snap connector. The harness or belt does not form part of the exercise apparel. The length of the resistance bands is adjustable at the snap connector.

U.S. Pat. No. 5,708,976 to Dicker discloses an exercise suit that has an elastic block secured to the chest region or back region of the suit. Resistive bands are adjustably connected at a first end to the elastic block and at a second end to an adjustable thumb stirrup. Bottom ends of the shirt are secured together in the crotch region to ensure that the suit stays more or less in place on the wearer's body. A separate pair of exercise pants is also disclosed. The pants include foot stirrups and adjustable suspenders that pass over the wearer's shoulders. A plurality of resistive bands extend through the legs and between the suspenders and the foot stirrups.

There is therefore need in the art for an improved exercise suit that is easily adjusted by the wearer when worn and during workouts, which provides for a wide range of adjustment and which prevents accidental dislodgement of the tension adjustment mechanisms during exercise.

SUMMARY OF THE INVENTION

The device of the present invention is an exercise suit which includes a resilient band extending through a guide pocket in a first direction along a pant leg or sleeve of the suit. The band engages a direction changing means near the end of the leg or sleeve and at least a portion of the band extends there beyond in a second direction. A free end of the band is releasably engaged with a tension adjustment mechanism provided on the exterior of the leg or sleeve a distance away from the direction changing means. The wearer adjusts the tension in the band by moving a length of the band through the direction changing means and repositioning the free end on the tension adjustment mechanism. A cover is removably disposed over the tension adjustment mechanism to prevent accidental dislodgement of the free end of the band.

In accordance with the invention the exercise suit comprises a front and a back adapted to cover a torso of a wearer; a pair of first tubular members extending outwardly from the front and back and adapted to receive the wearer's arms therethrough; a pair of second tubular members extending outwardly from the front and back and adapted to receive the wearer's legs therethrough; a resilient band extending in a first direction along one of the first and second tubular members from the front and back and toward a first end thereof, said band having a first free end and a second free end; a first direction changing means disposed proximate the first end of the one of the first and second tubular members; wherein said band engages the first direction changing means and at least a portion of the band extends there beyond in a second direction; and a first tension adjustment mechanism disposed a distance inwardly from the first end of the one of the first and second tubular members; and wherein the first free end of the band is releasably engageable with said first tension adjustment mechanism.

A resilient band may be provided on each of the legs and sleeves of the suit and a guide pockets for retaining the band is situated on the interior surface of the suit or on the exterior surface thereof. Each guide pocket is either a single elongated member that extends from one end of the leg or sleeve to the other or is comprised of smaller segments that are separated from each other but are generally aligned with each other. Still further, the guide pocket may be two separate segments, one of which extends down the entire length of either an inner side or outer side of the leg or sleeve and the other of which extends only partially down the length of the other of the inner side and outer side of the leg or sleeve. In this latter instance, the resilient band will extend across an opening in the leg or sleeve through which the foot or hand will extend. Consequently, the band comes into engaging contact with the foot or hand and aids in keeping the suit in a generally fixed position on the wearer's body. Other anchoring components may be utilized instead of bringing the band into contact with the wearer's hand or foot.

BRIEF DESCRIPTION OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

Figure 1:
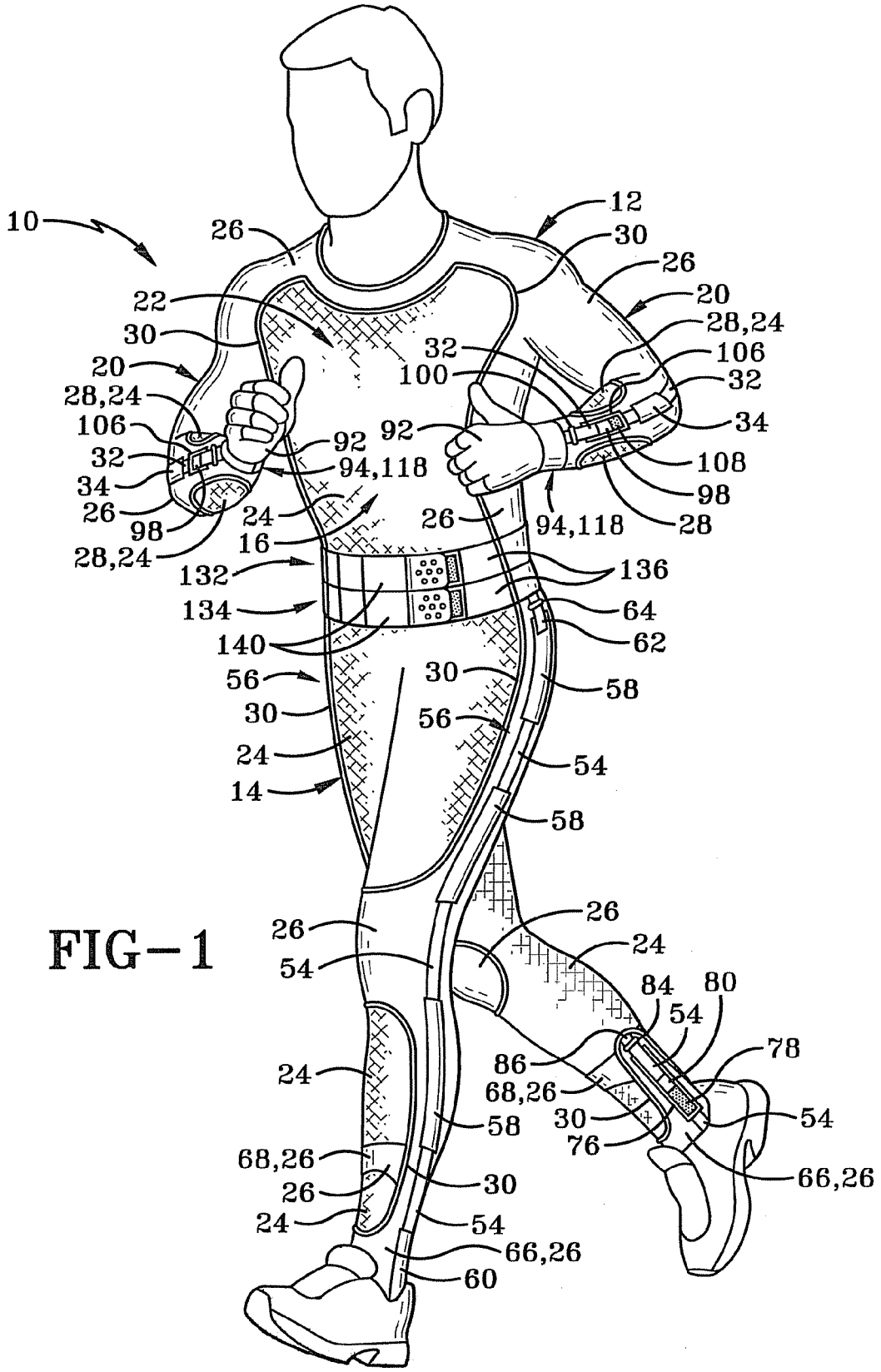
FIG. 1 is a front perspective view of a first embodiment of an exercise suit in accordance with the present invention.
Figure 2:
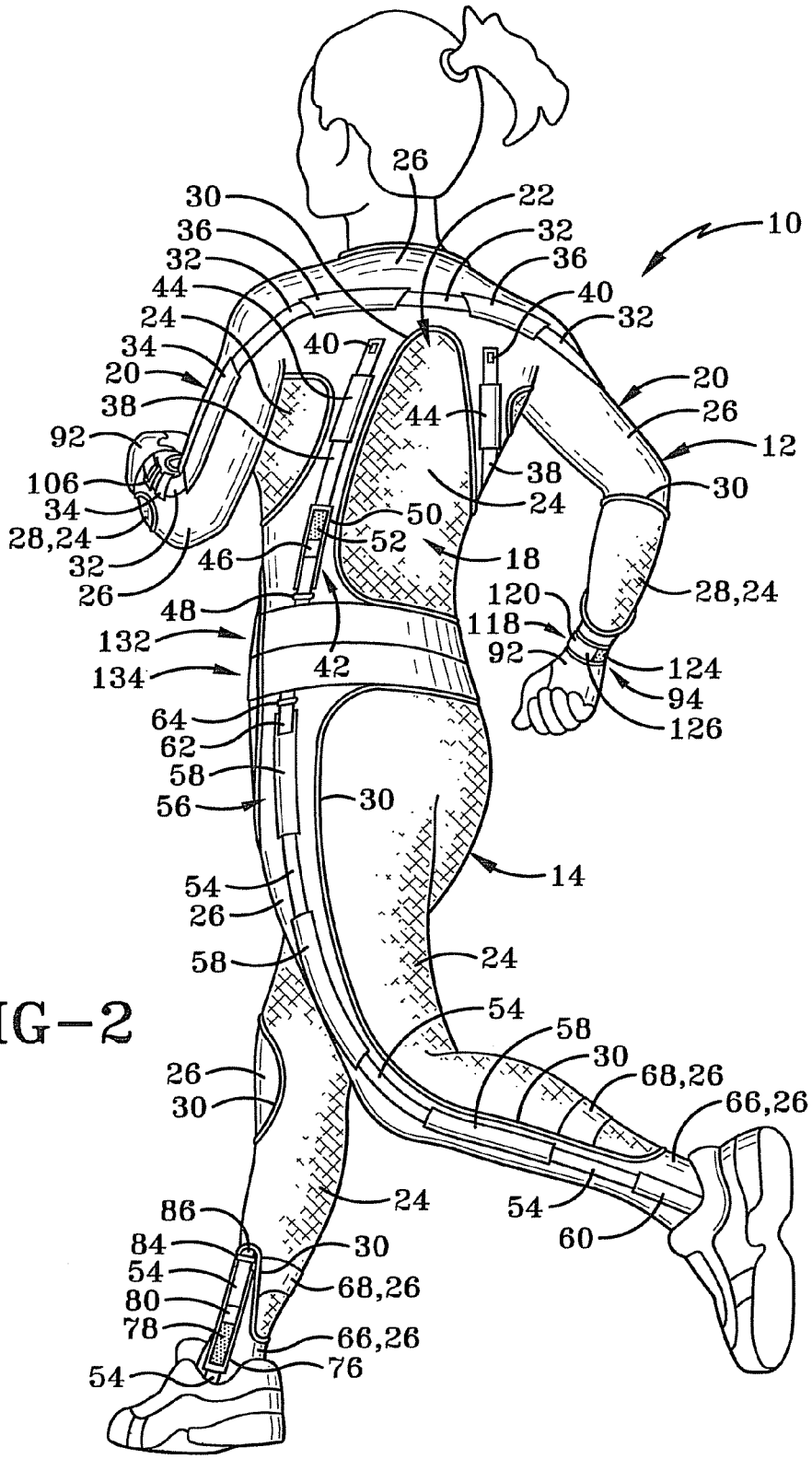
FIG. 2 is a rear perspective view of the exercise suit of FIG. 1.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

A first embodiment of an exercise suit in accordance with the present invention is indicated generally at 10, and is particularly shown in FIGS. 1 through 8. As particularly shown in FIGS. 1 and 2, exercise suit 10 preferably comprises a separate shirt 12 and pants 14 but could also be a unitary device that essentially covers the wearer's entire body.

Shirt 12 is preferably manufactured as a single piece with a front side 16 and a rear side 18. A pair of tubular sleeves 20 extend from a core 22 made from front and rear sides 16, 18. Shirt 12 includes openings for the neck, wrists and waist of the wearer. The shirt preferably is manufactured from two materials, a more flexible, elastic material 24 and a less flexible, less elastic or what will be termed herein as a "rigid" material 26. Suitable flexible materials 24 include polyesters, spandex or materials sold under the registered trademark LYCRA. Material 24 may also be moisture wicking or compressive in nature. Rigid material 26 provides stability in the suit as well as ensures a constant fit for the wearer. Elastic material 24 is preferably used to make core 22 and foresleeve panels 28, while ridged material 26 is preferably located along the suit's shoulder regions, the regions of the sleeves other than foresleeve panels 28, and the side panels. A reflective piping 30 may be utilized along the seams between the panels made from elastic material 24 and those made from rigid material 26. It will be understood by those of ordinary skill in the art that a wide variety of different fabrics and materials may be used in the construction of exercise suit 10 without departing from the scope of the invention and the materials identified herein should not be considered limiting. Additionally, while exercise suit 10 is illustrated as a form-fitting suit, it will be understood that this too is not to be considered a limiting factor and that looser or loose fitting apparel is also considered to fall within the scope of the present invention.

In accordance with a specific feature of the present invention, shirt 12 includes a resilient band 32 that is positioned to extend in from the left wrist region 94 of suit 10, along the left sleeve, across the upper region of rear side 18 (FIG. 2), along the right sleeve and terminate at the right wrist region 94 of suit 10. A portion of resilient band 32 extends outwardly for a distance beyond each wrist region 94 and is foldable back upon itself by being passed through a direction changing means and is then secured to a tension adjustment mechanism provided on the exterior surface of the suit 10. The direction changing means and tension adjustment mechanism will be described in greater depth hereafter.

Resilient band 32 is provided to increase resistance to the wearer moving their limbs and preferably is an elastic strip or cord of any cross-sectional shape. Preferably, resilient band 32 is manufactured from a material such as natural rubber that can be increased in length by pulling or pushing on the same but which will return substantially to its original length when released. Resilient band 32 has a length and a width and includes first and second free ends 98 with an intermediate region disposed between ends 98. First free end 98 is disposed adjacent left wrist region 94 and second free end 98 is disposed adjacent right wrist region. As is evident from FIG. 5, each free end 98 of resilient band 32 preferably is reinforced in some manner such as by including a housing 99 disposed thereover. This makes it easier for the wearer to grasp free end 98 to adjust resilient band 32 as will be hereinafter described.

Suit 10 further includes one or more guide pockets through which resilient band 32 is threaded. These guide pockets comprise pockets of fabric that are sewn or otherwise secured to the exterior surface of suit 10 and include wrist guide pockets 106 disposed adjacent each of the left and right wrist regions 94, sleeve guide pockets 34, and back guide pockets 36. Guide pockets 34, 36 and 106 correctly position resilient band 32 for exercising. It will of course be understood that instead of wrist guide pockets 94, sleeve guide pockets 34 and back guide pockets 36, resilient band 32 may alternatively be threaded through a single continuous guide pocket that extends from proximate left wrist region 94 to proximate right wrist region 94, without departing from the scope of the present invention.

As indicated above and in accordance with a specific feature of the present invention, suit 10 is provided with a direction changing means that is disposed a spaced distance from wrist region 94 and from an end of a wrist guide pocket 106. The direction changing means causes band 32 to be redirected from extending in a first direction to extending in an opposed second direction. On left or right sleeves, the direction changing means comprises a ring 100 that is secured to the exterior surface of the suit by a strap 104. Ring 100 is disposed adjacent the wrist region 94 of the sleeve and a spaced distance from a tension adjustment mechanism that will be described hereafter. Ring 100 defines an aperture therethrough (not numbered) that preferably is oriented generally at right angles to the direction of extension of the resilient band 32 and resilient band 32 extends movably through this aperture. Preferably, band 32 is able to slide in one of the first and second directions through the aperture by either being pulled or by being released. Ring 100 preferably is a strong, rigid member made out of metal or plastic which enables the wearer to pull resilient band 32 tighter without causing undue stress and damage to the fabric of suit 10. It will be understood, however, that ring 100 may also be comprised of a loop of fabric or some other less rigid material without departing from the scope of the invention. Additionally, while ring 100 is shown as being secured to the sleeve by strap 104 that generally holds it at right angles to the direction of extension of band 32, it may also be mounted to suit 10 in such a way that it is able to swivel or pivot so that it is held at angles other than 90° relative to the direction of extension of band 32.

As indicated previously and in accordance with a specific feature of the present invention, suit 10 is provided with a tension adjustment mechanism 101 disposed at one, but preferably at both, free ends 98 of resilient band 32. This tension adjustment mechanism 101 is provided to enable the wearer to adjust the tension in resilient band 32 and to then lock the resilient band 32 in that adjusted condition. In accordance with a specific feature of the invention, the tension adjustment mechanism 101 comprises a first fastener component that is secured to an exterior surface of suit 10 and a second fastener component that is secured to free end 98 of resilient band 32. First and second fastener components are selectively engageable with each other to lock the resilient band 32 in a particular tensioned state. First and second fastener components are selectively disengageable from each other to allow the wearer to adjust the tension in resilient band 32.

In the first embodiment of suit 10 illustrated in FIGS. 1-8, the first fastener component of the tension adjustment mechanism 101 comprises a first piece of one of a hook and loop fastener 108 that is secured to an exterior surface of wrist guide pocket 106. The second fastener component of the tension adjustment mechanism 101 comprises a second piece of the other of a hook and loop fastener 102 that is secured to free end 98 of resilient band 32. Hook and loop fasteners 108 and 102 are pushed together to lock resilient band 32 in a particular tensioned condition and are separated from each other to permit adjustment in the tension therein. In order to adjust the tension in resilient band 32, the wearer will disengage second fastener component 102 from first fastener component 108 and if they wish to increase the tension in resilient band 32, they will pull free end 98 in the direction indicated by arrow 112 in FIG. 5. This pulling motion slides an additional length of resilient band 32 through ring 100, thereby increasing the tensile forces in resilient band 32. Once the desired tension is attained, second fastener component 102 on free end 98 of band 32 is engaged with first fastener component 108 by moving the same in the direction of arrow 116. As will be obvious, increasing the length of that piece of the resilient band 32 which extends outwardly beyond ring 100, will result in second fastener component 102 being engaged on first fastener component 108 in a different location to the initial location of its engagement thereon. That different location will be located further from wrist region 94 that the initial location. The direction changing means, ring 100, enables the wearer to apply leverage to resilient band 32 and thereby enables the wearer to apply less force to increase the tension in band 32. The positioning of ring 100 also enhances the action of the ring in that it is easier to apply force at the extremities of the limbs than it is to apply force closer to the torso.

If the wearer decides they wish to decrease the tension in resilient band 32, they disengage second fastener component 102 from first fastener component 108. The wearer then moves free end 98 in such a manner that a length of resilient band 32 will slide back through ring 100 in the direction indicated by arrow 114. Thus, the piece of resilient band 32 that extends outwardly beyond ring 100 is shortened and, once again, when the desired tension is attained, second fastener component 102 is engaged with first fastener component 108, and the location of that engagement will be different to the initial location of engagement. In particular, the different location will be disposed closer to wrist region 94 than was the initial location.

Since a tension adjustment mechanism 101 is provided at both ends of resilient band 32, the wearer of exercise suit 10 will be able to make adjustments to the tension in resilient band 32 at both free ends 98 thereof. Furthermore, the location of the tension adjustment mechanism 101 on the outside of the suit and specifically in an area that is disposed between where the wearer's hand and elbow are situated, also enables the wearer to make these tension adjustments while they are wearing the suit 10 and even while they are actively exercising in the suit 10.

It should be understood that while tension adjustment mechanism 101 is described and illustrated herein as being two regions of hook and loop fastener 108, 102, any suitable type of cooperating and adjustable fastener components can be utilized to change the tension in resilient band 32 without departing from the scope of the present invention. Thus, the tension adjustment mechanism 101 can instead utilize mating ratcheting-type connectors, interlocking buckles, snaps, zippers, hooks, ties, buttons and mating button holes, magnets, mating male and female connectors, mating roller blade style zip clips, etc.

In accordance with another feature of the present invention, shirt 12 also includes an additional pair of core resilient bands 38. Core resilient bands 38 are anchored into rear side 18 of shirt 12 and extend generally vertically between the waist region of shirt 12 and a position that will fall generally adjacent one of the shoulder blades of a person wearing suit 10. A first end of each resilient band 38 is fixedly secured to rear side 18 by stitching 40. Each resilient band 38 is passed through spaced apart back guide pockets 44, 50 and then a second end of resilient band 38 is threaded through a direction changing means in the form of ring 48. Ring 48 is disposed adjacent the waist region of shirt 12 and changes the direction of a portion of resilient band 38 so that the free end 46 thereof is disposed a short distance above ring 48 and further away from the waist region. A tension adjustment mechanism 42 is provided to engage each resilient band 38 so that the wearer is able to adjust the tension in resilient bands 38. As with tension adjustment mechanism 101, tension adjustment mechanism 42 includes a first and a second fastener component that are engageable with each other. The first fastener component 52 is secured to an exterior surface of exercise suit 10 and the second fastener component (not shown) is secured to free end 46 of resilient band 38. Preferably, first fastener component 52 is secured to an exterior surface of back guide pocket 50. In the preferred embodiment of the invention illustrated in FIGS. 1-8, the first and second fastener components are, once again, preferably hook and loop fasteners that are selective engageable with and disengageable from each other. Tension adjustment mechanism 42 functions in essentially the same manner as the tension adjustment mechanisms 101 on sleeves 20 with the exception that the wearer will likely make the necessary adjustments to the tension in resilient band 38 before they put the shirt on. Alternatively, another person will need to make the tension adjustments when the wearer is wearing suit 10 as the wearer simply cannot reach tension adjustment mechanisms 42 easily. It will of course be understood that any suitable type of first and second fastener components can be utilized in tension adjustment mechanism 42 without departing from the scope of the present invention.

As indicated previously, exercise suit 10 further comprises a pair of pants 14 made from a combination of the elastic material 24 and rigid material 26. Pants 14 are comprised of a front side and a rear side and include a waist opening at the top end thereof and two tubular pant legs 56 extending downwardly from the bottom thereof. Pant legs 56 further define two ankle openings at the bottom of pant legs 56.

In accordance with the present invention, pants 14 are provided with a pair of resilient bands 54. Each resilient band 54 extends from proximate one side of the waist region of pants 14, down the outer side of one of the pant legs 56 that would be disposed along the outer side of the wearer's leg, across the ankle opening at the bottom of the pant leg 56 and for a short distance up the inside of the pant leg 56 that would be disposed adjacent the inner side of the wearer's leg. Resilient band 54 extends upwardly along the inside of pant leg 56 to an area that would be generally mid-way between the wearer's knee and ankle. As was the case with resilient bands 32 and 38, resilient band 54 is threaded through a plurality of guide pockets 58, 60, 76 that are secured to the exterior surface of pant legs 56. A first tension adjustment mechanism 61 is provided proximate the waist region of pants 14 and a second tension adjustment mechanism 81 is provided proximate the ankle region of pant legs 56 on the inner side thereof. First tension adjustment mechanism 81 is designed to be engaged by first free end 64 of resilient band 54 and second tension adjustment mechanism 81 is designed to be engaged second free end 80 of resilient band 54.

A direction changing means in the form of ring 64 is provided adjacent first tension adjustment mechanism 61 to change the direction of resilient band 54 as it extends upwardly toward the waist region and to redirect it so that it extends downwardly toward first tension adjustment mechanism 61. The first free end 62 of resilient band 54 includes a first fastener component of tension adjustment mechanism 61 and a second fastener component thereof is provided on guide pocket 58. Although not illustrated in detail herein, first and second fastener components of tension adjustment mechanism 61 comprise the mating portions of a hook and loop fastener. Tension adjustment mechanism 61 is of a substantially identical structure and function to tension adjustment mechanisms 101 and 42 described previously herein.

Similarly, a direction changing means in the form of a ring 84 is provided adjacent second tension adjustment mechanism 81. Ring 84 is secured to a strap 86 that is sewn to the exterior surface of pants 14. Preferably, the fabric that is used to construct the area surrounding ring 84 and strap 86 is of the more-rigid, non-stretch type as this aids in anchoring that region of suit 10 on the wearer's body. Preferably, this region of more-rigid fabric is provided in a location of the pant legs to completely encircle the wearer's calf. Resilient band 54 is threaded through ring 84 so that it is redirected in that it no longer extends upwardly toward the waist region of pants 14 but instead extends downwardly toward the ankle region thereof. Band 54 is therefore essentially folded back on itself Second tension adjustment mechanism 81 comprises a first and second fastener component that are selectively engageable with each other. In particular, first fastener component 82 of tension adjustment mechanism 81 comprises one of a hook and loop fastener that is secured to free end 80 of resilient band 54 and second fastener component 78 comprises the other of the hook and loop fastener and is secured to an exterior surface of guide pocket 76. Once again, tension adjustment mechanism 81 functions in substantially an identical manner to tension adjustment mechanisms 101, 42, and 61. Tension adjustment mechanism 81 is disengaged by moving free end 80 in the direction indicated by arrow 88 and is engaged by moving free end 80 in the direction indicated by arrow 93. To increase the tension in resilient band 54, the free end 80 thereof is moved in the direction indicated by arrow 90 and to decrease the tension therein, the free end 80 is moved in the direction indicated by arrow 91.

Inasmuch as tension adjustment mechanisms 61, 81 are provided at free ends 62, 80 of resilient band 54, the wearer of exercise suit 10 is able to adjust the tension in resilient band 54 by adjusting one or both tension adjustment mechanisms 61, 81 when the suit is worn. The positioning of tension adjustment mechanisms 61, 81 is advantageous in that these locations are easy for the wearer to reach. Particularly, the tension adjustment mechanisms 61 on the hip regions of the pants 14 are readily adjustable during an exercise routine. Once again, it should be understood that tension adjustment mechanisms 61 and 81 do not have to comprise mating hook and loop fasteners but can be of any other type or configuration that will allow the wearer of the suit to easily disengage the free ends 62, 80 of resilient bands 54, change the tension in the same and then engage the ends once again to lock the resilient bands 54 in the adjusted position.

Figure 4:
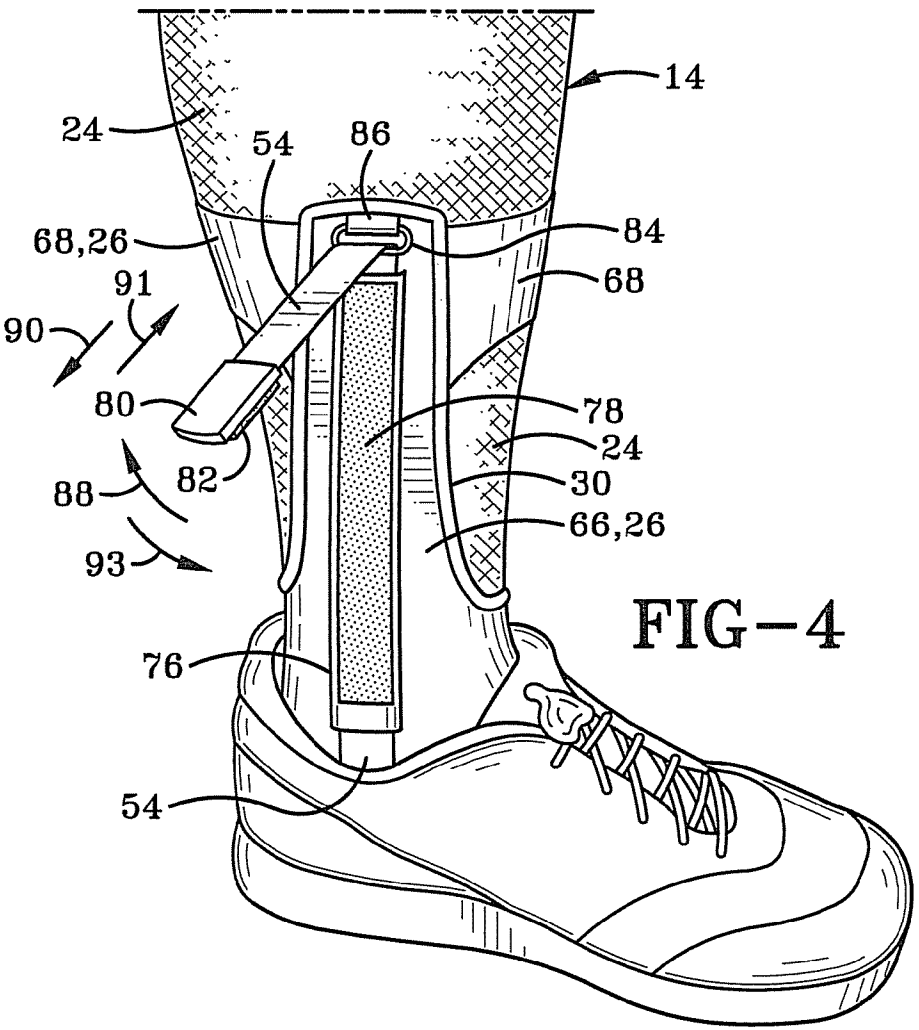
FIG. 4 is an enlarged right side perspective view of the bottom end of the left pant leg 56 showing the adjustment mechanism being adjusted.
Figure 3:
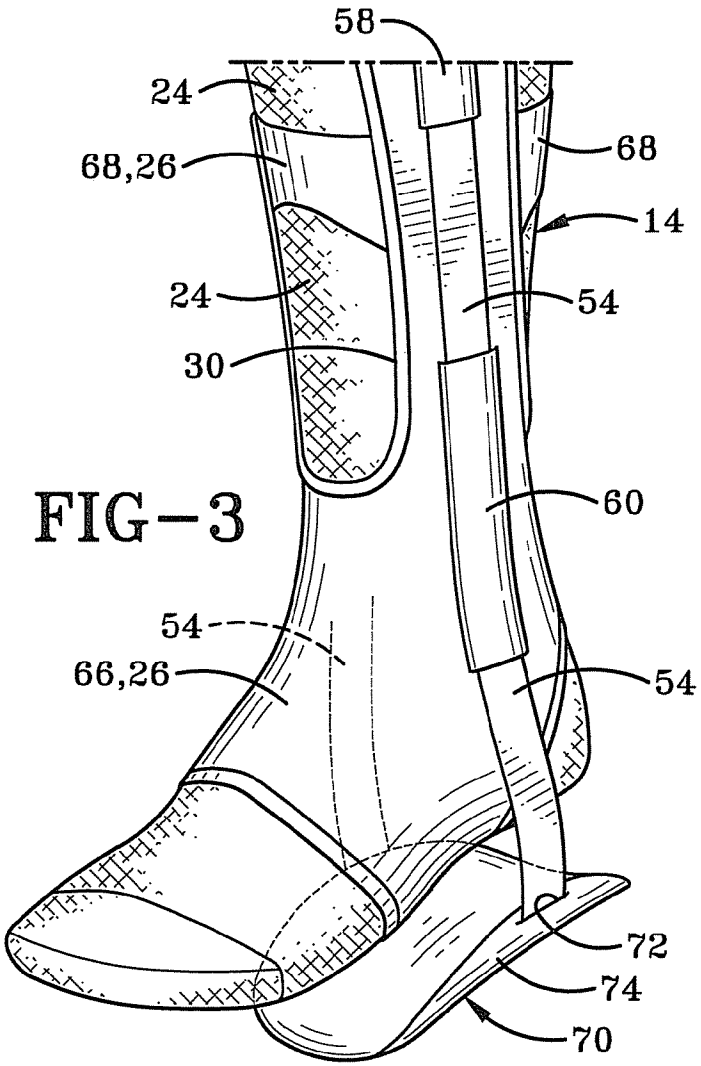
FIG. 3 is an enlarged left side perspective view of a bottom end of a left pant leg 56 of the exercise suit and showing an arch support being positioned beneath a wearer's foot.

FIGS. 3 and 4 illustrate inner and outer views of a wearer's lower left leg region showing other component parts of exercise suit 10 in greater detail. In accordance with yet another feature of the present invention, a foot and ankle wrap 66 extends downwardly from pant leg 56. Wrap 66 preferably surrounds the wearer's foot and ankle and acts as an anchor to increase stability. A calf strap 68 preferably is provided to maintain the wrap 66 in the desired location. Both wrap 66 and strap 68 aid in preventing suit 10 from shifting on the body as tension is increased in the various resilient bands.

Exercise suit 10 further includes an arch support 70 that is engaged on resilient band 54. Resilient band 54 is threaded through a pair of holes 72 disposed on opposing sides of arch support 70 so that arch support 70 is slidable along resilient band 54 when the resilient band is tightened or released by the wearer. In this way, arch support 70 is always able to be positioned in the appropriate location beneath the lower surface of wrap 66 and in the correct position to support the wearer's foot arch. Additionally, any pulling motion on resilient band 54 when the wearer of exercise suit 10 is standing with their weight on arch support 70 will cause a portion of resilient band 54 to slide through the two spaced apart holes 72 while permitting arch support 70 to remain in place. In this way, the wearer of suit 10 is able to adjust the tension in resilient band 54 without having to remove their shoes or to sit down and fiddle with the positioning of arch support 70. It should also be noted that arch support 70 preferably has gently rounded edges 74 so that it is comfortable for the wearer to use. Instead of being an active arch support, component 70 may instead simply be a soft durometer plastic pad that aids in distributing the pressure of resilient band 54 under the wearer's heel.

Figure 5:
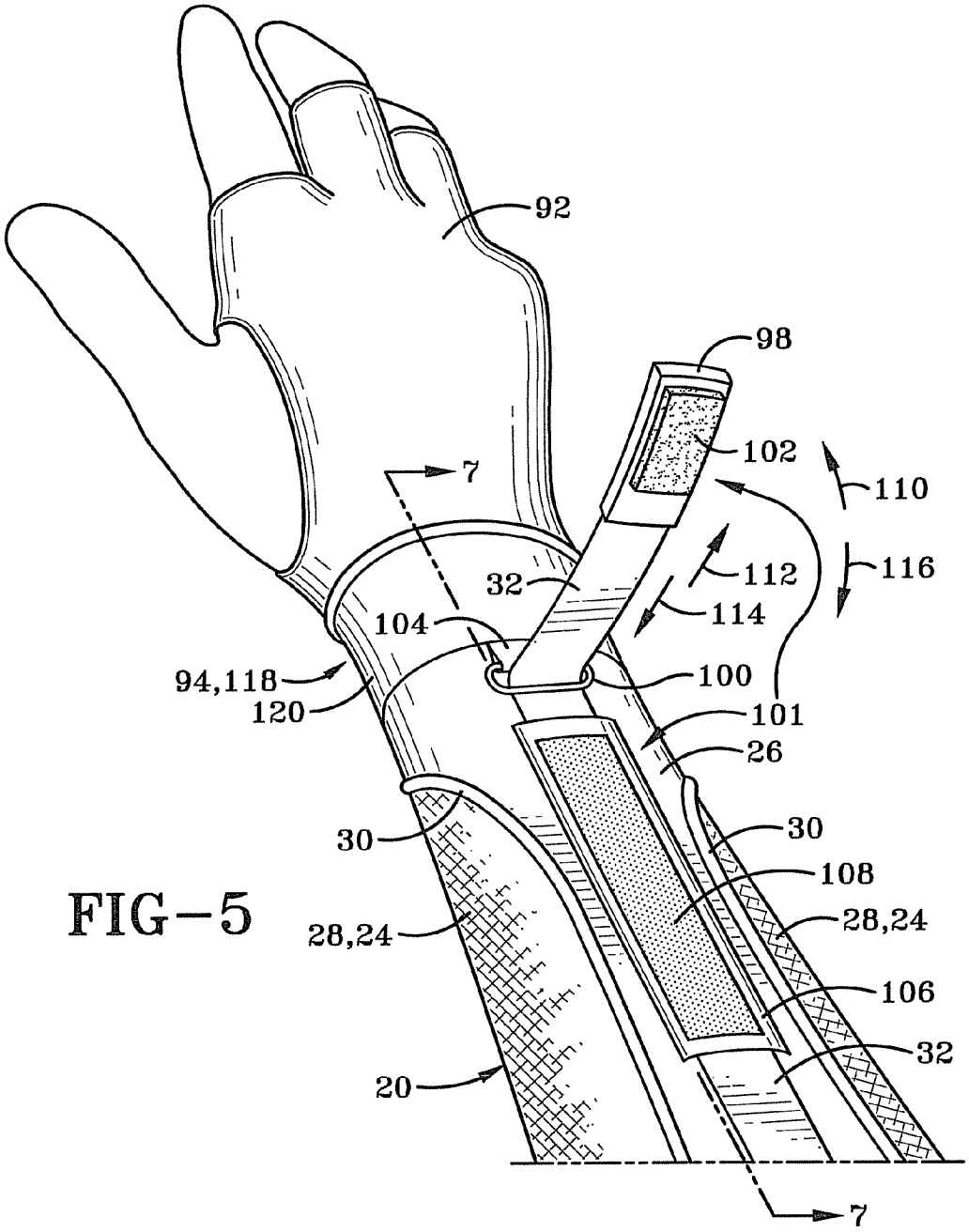
FIG. 5 is an enlarged top perspective view of a right sleeve of the suit shirt with the adjustment mechanism disengaged and the length of the resilient band being adjusted.
Figure 6:
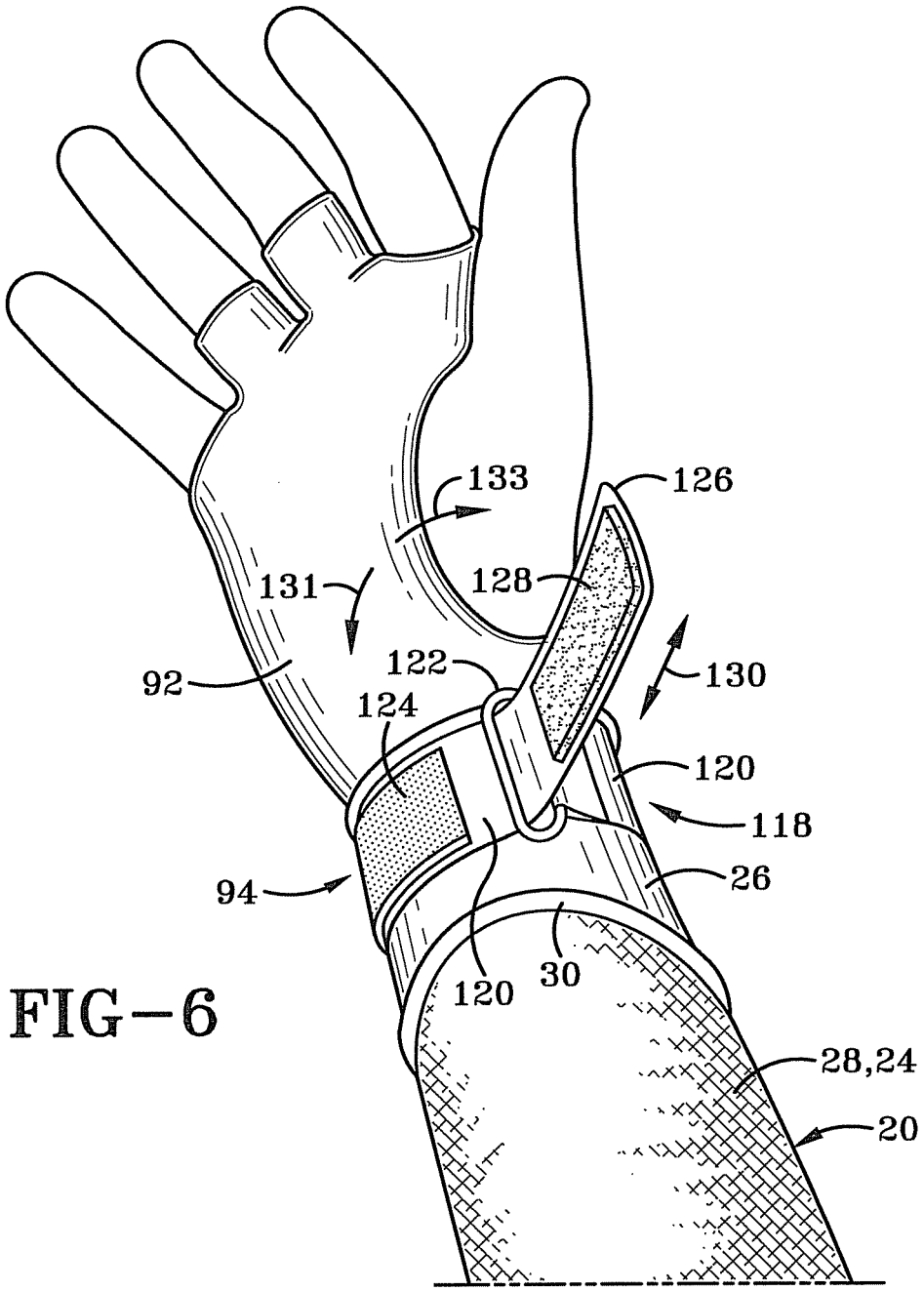
FIG. 6 is an enlarged bottom perspective view of the right sleeve of the suit shirt showing a stabilizing strap being adjusted.
Figure 7:
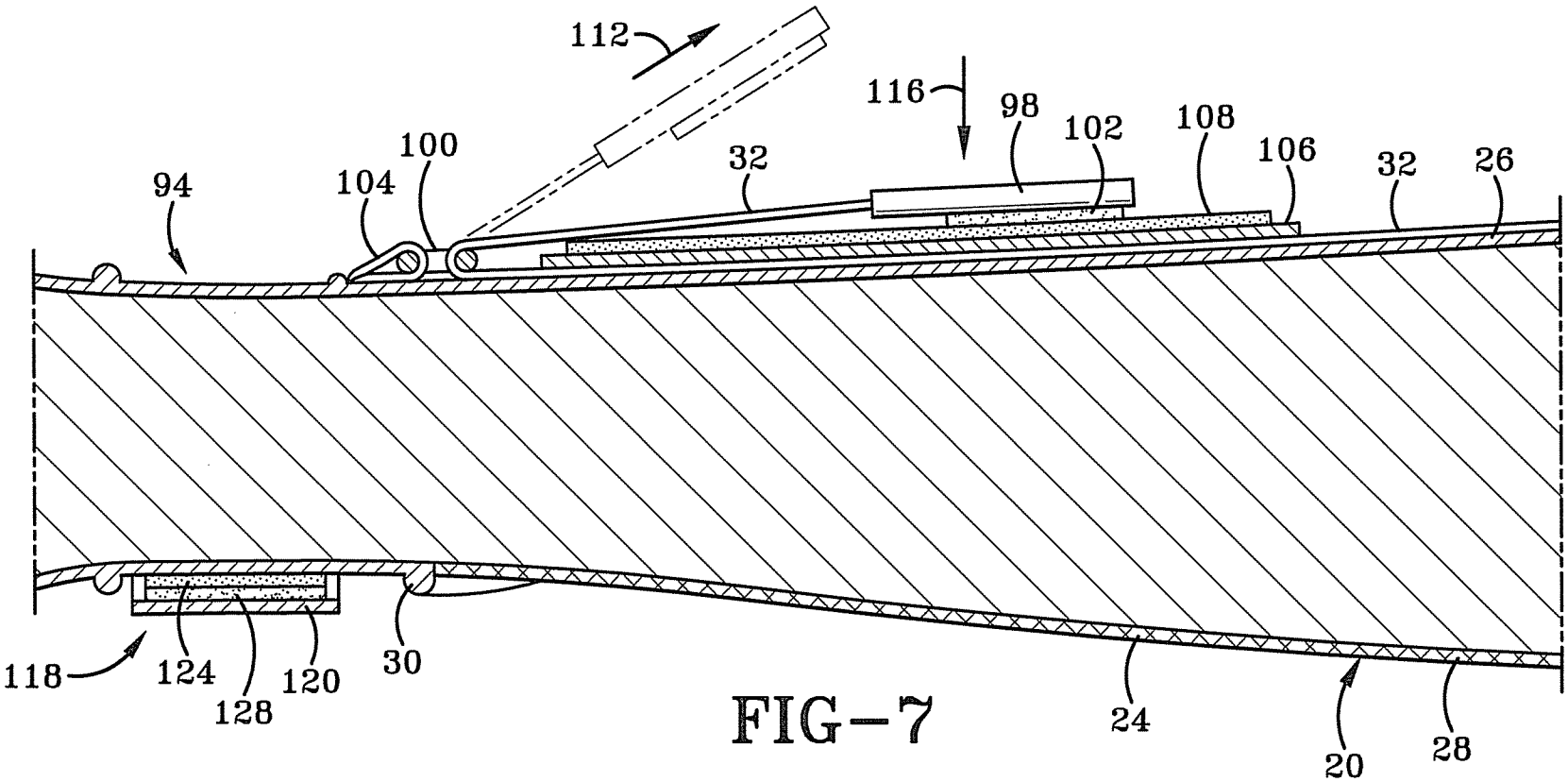
FIG. 7 is a cross-sectional left side view of the right sleeve of the suit shirt taken along line 7-7 of FIG. 5 and showing the sleeve resilient band in both an adjusted and a secured position.

FIGS. 5 through 7 illustrate an enlarged view of the right sleeve 20. In accordance with another feature of the invention, each sleeve 20 preferably include a glove 92 to aid in anchoring wrist region 94 and preventing the sleeve from shifting on the wearer's body as the tension in resilient band 32 is changed. Glove 92 may include openings to allow the wearer's fingers to extend there through and may be formed integral with wrist region 94. Although not illustrated herein, in an alternative embodiment, glove 92 may be separable from sleeve 20 and may further include a ring or other attachment device to allow sleeve resilient band 32 to extend there through. Advantageously, this arrangement allows the user to selectively utilize glove 92 to increase resistance without requiring the glove to be used at all times.

In accordance with another feature of the present invention and referring specifically to FIG. 6, a wrist stabilizer 118 includes a strap 120 having a ring 122 and a hook and loop fastener 124. Strap 120 terminates with an end 126 having a hook and loop fastener 128. End 126 passes through ring 122 and is then folded backwards to connect hook and fasteners 124 and 128. Specifically, the wearer pulls end 126 in the direction associated with arrows 130 until the proper tension is achieved and the end is then folded in the direction associated with arrow 131 to latch the wrist stabilizer and in the direction associated with arrow 133 to unlatch the wrist stabilizer. In a preferred embodiment, a wrist stabilizer is utilized at both wrists and helps reduce any strain on the wearer's hands at glove 92 which may be caused by resilient band 32 pulling the glove. Further, wrist stabilizer 118 insures that the tension in resilient band 32 remains substantially consistent by maintaining the position of ring 100 thereby aiding in maintaining tension in resilient band 32.

Figure 8:
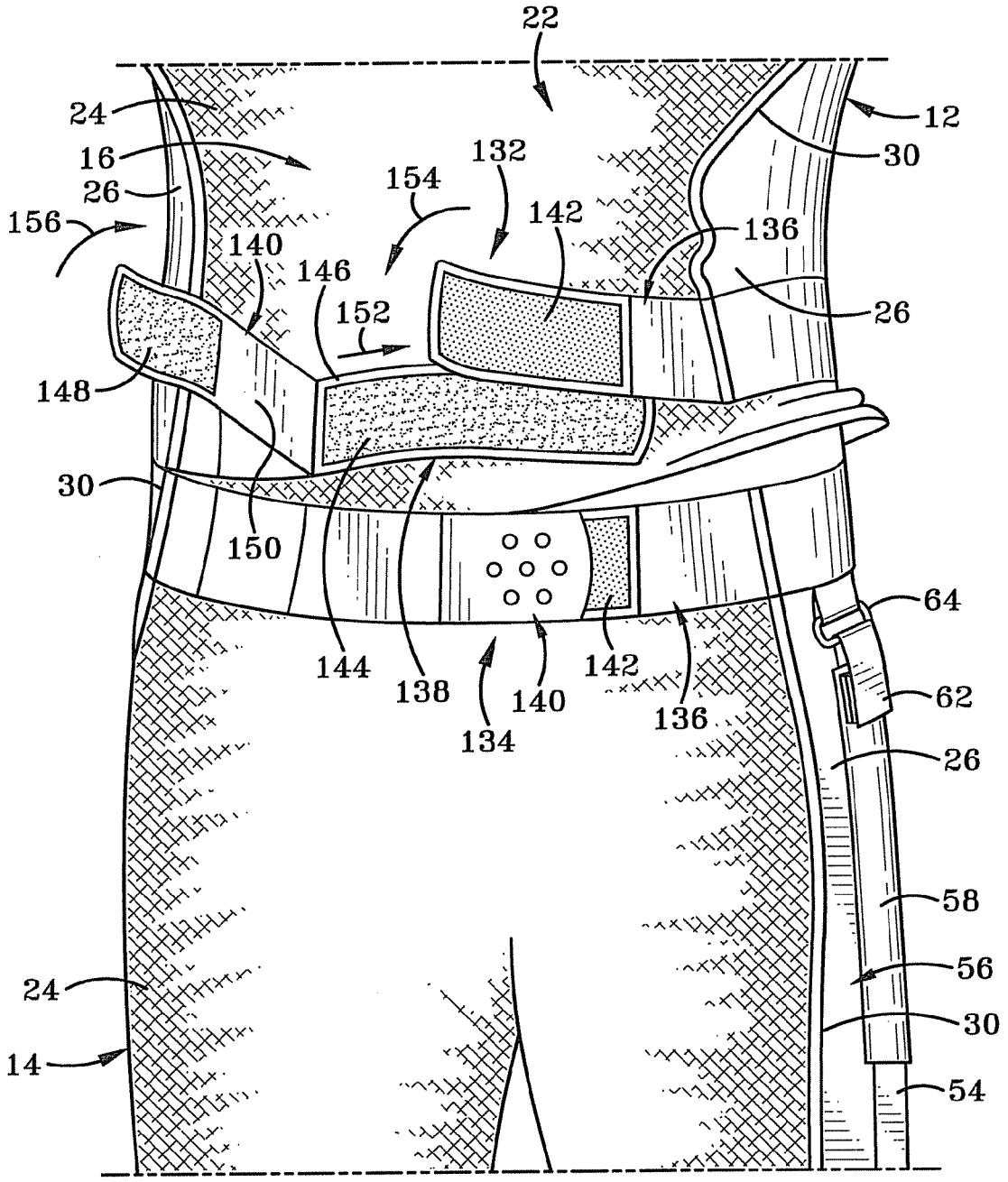
FIG. 8 is an enlarged front view of a mid-section of the exercise suit illustrating an upper and lower girdle belt disposed thereon.
Figure 9:
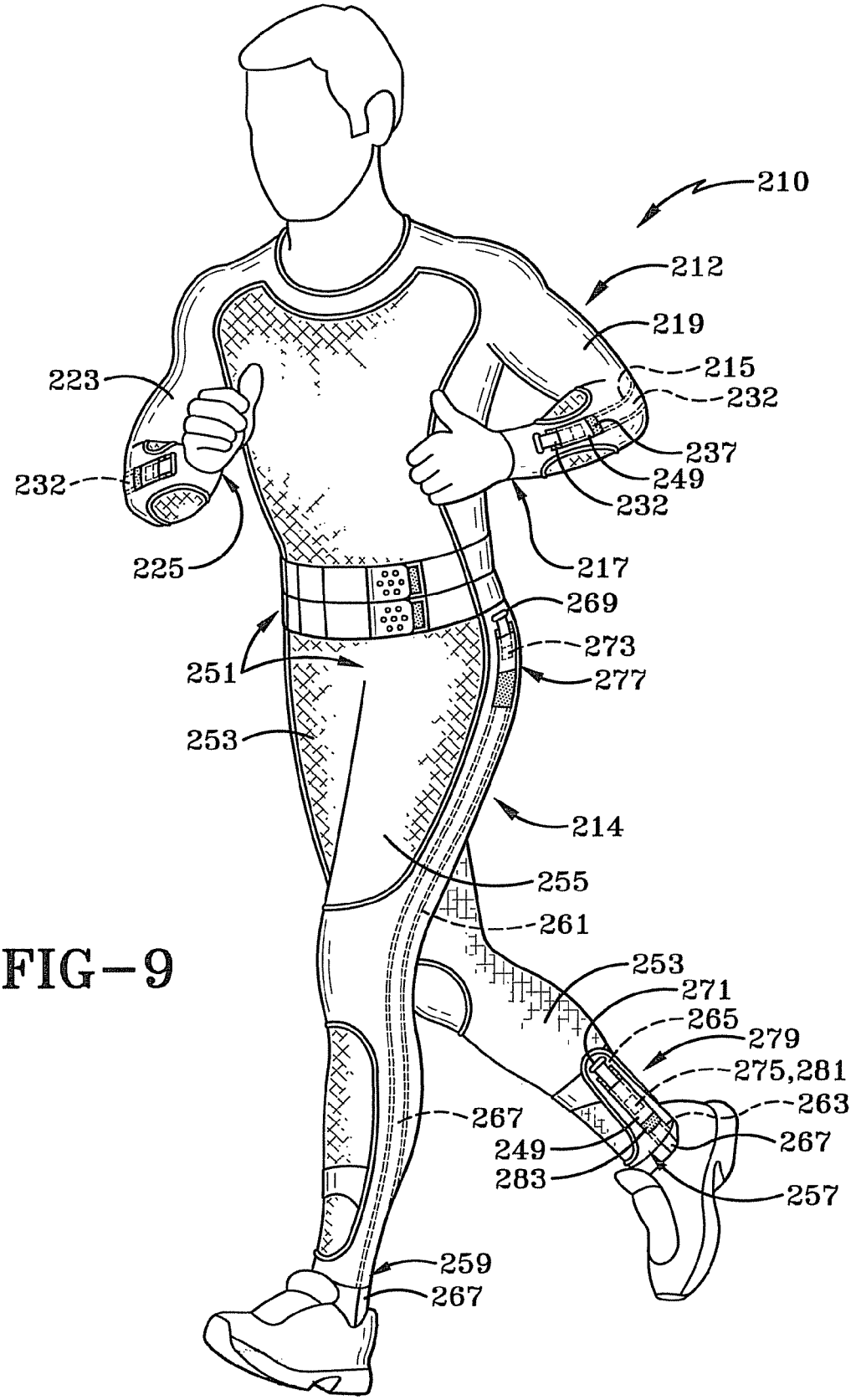
FIG. 9 is a front perspective view of a second embodiment of an exercise suit in accordance with the present invention.
Figure 10:
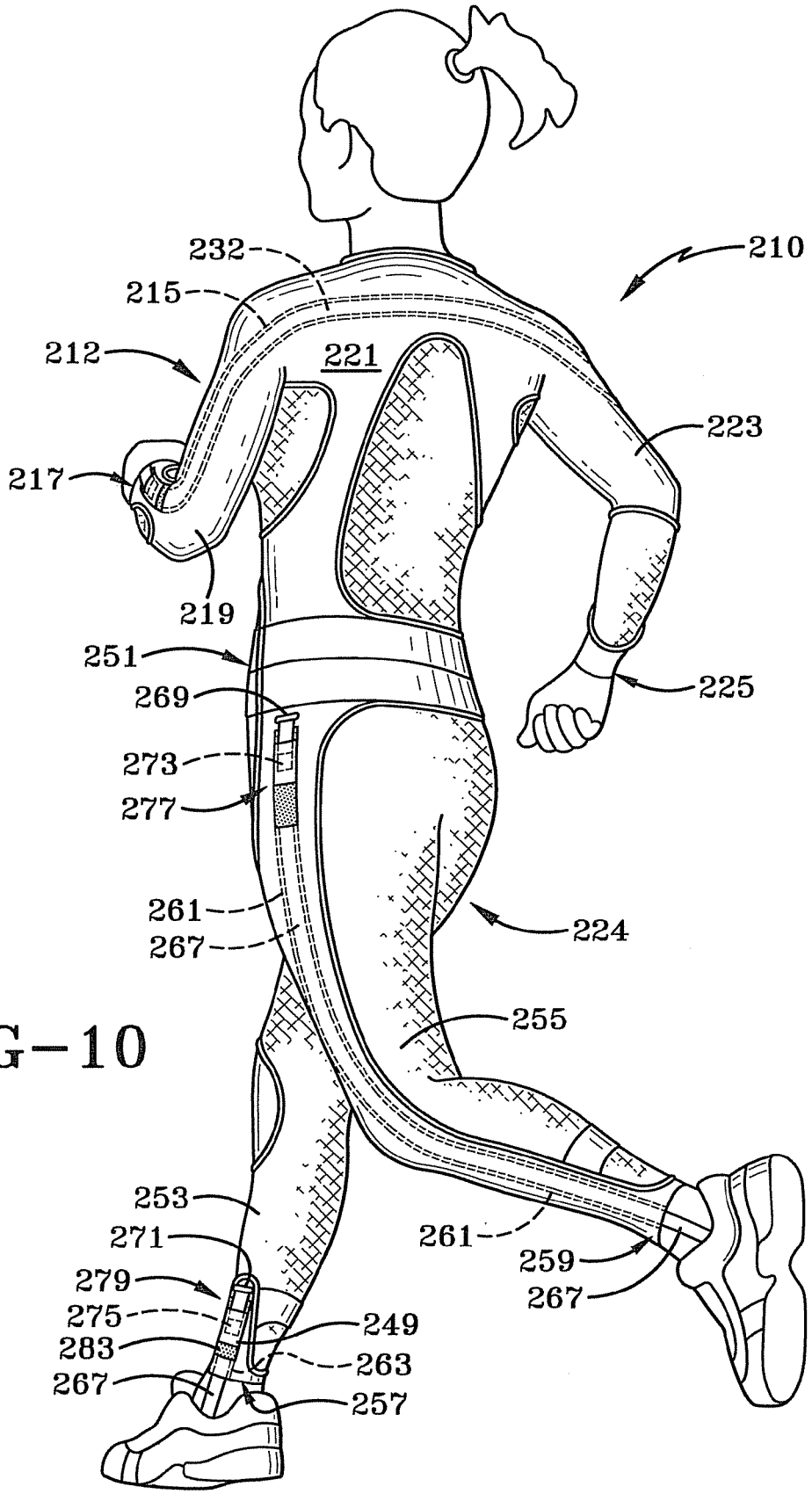
FIG. 10 is a rear perspective view of the exercise suit of FIG. 9.
Figure 12:
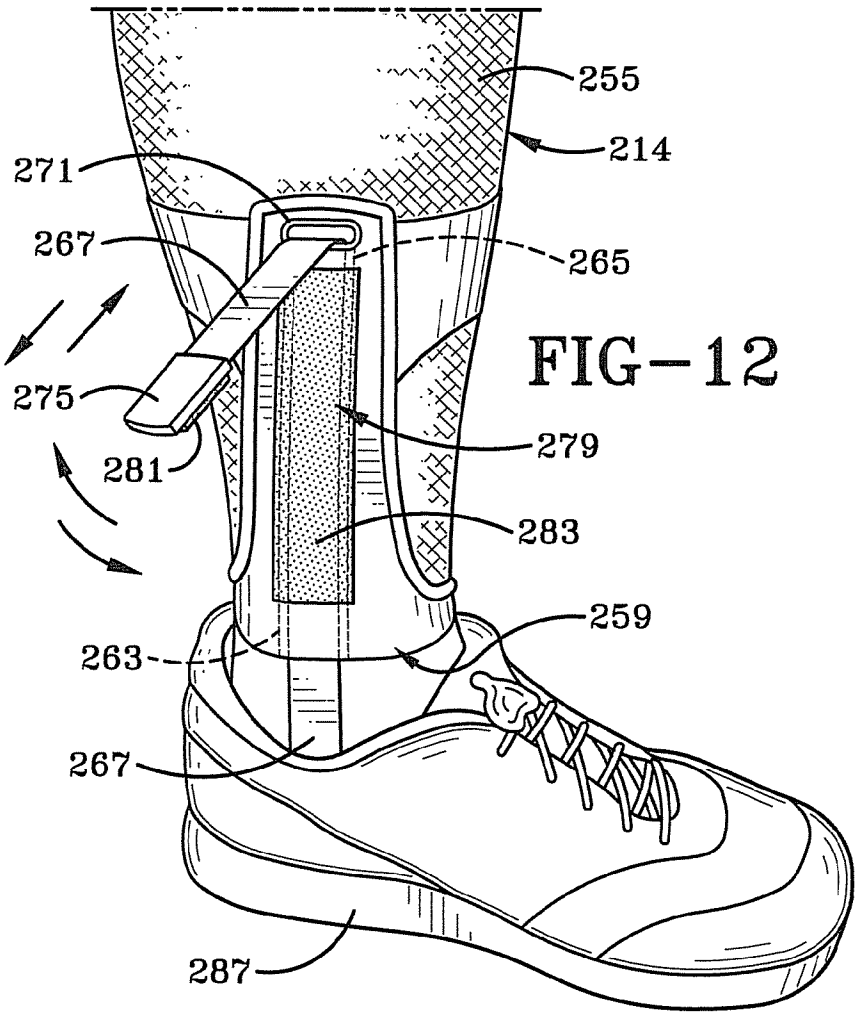
FIG. 12 is an enlarged right side perspective view of the bottom end of the left pant leg 56 showing the adjustment mechanism in a secured position and showing a removable cover disposed adjacent the closed adjustment mechanism.

FIG. 8 illustrates a belt girdle 132 located at the bottom of shirt 12 and a second belt girdle 134 located at the top of pants 14. While exercise suit 10 may be formed as a single unit, a preferred embodiment separates shirt 12 and pants 14. Separating shirt 12 and pants 14 requires that each be maintained in a constant position to maintain the amount of resistance in the various resilient bands 32, 38. 54 as set by the wearer of the suit. Due to the fact that belt girdle 132 and second belt girdle 134 are structurally and functionally identical, only the belt girdle 132 will be described in detail.

Belt girdle 132 includes an intermediate belt 136 extending from one side of the shirt and an inner belt 138 and an outer belt 140 extending from the opposite side of the shirt. In a preferred embodiment, intermediate belt 136 extends from the wearer's left side and connects to ridged material 26 near elastic material 24 and piping 30. Intermediate belt 136 has a hook and loop fastener 142 on both sides of the belt. Inner belt 138 includes a hook and loop fastener 144 on a front side 146, while outer belt 140 has a hook and loop fastener 148 on a back side 150.

Having described the structure of the preferred embodiment belt girdles, a preferred method of operation will now be described in detail. Inner belt 138 of belt girdle 132 is laid across the wearer's core in the direction associated with arrow 152. Intermediate belt 136 is moved in the direction associated with arrow 154 and is secured to inner belt 138 so that hook and loop fastener 142 of one side of the intermediate belt is secured to hook and loop fastener 144. Next, outer belt 150 is folded in the direction associated with arrow 156 to secure hook and loop fastener 142 on the back side of intermediate belt 136 to hook and loop fastener 148. Accordingly, the belt girdles provide a tight fit around the wearer's core to insure that the shirt and pants remain in a constant position to provide increase resistance during exercise.

Thus, exercise suit 10 provides a separable shirt 12 and pants 14 which include adjustable exercise resilient bands to allow the wearer to increase the intensity of his/her exercising. Advantageously, the sleeve and shoulder resistance includes a single resilient band 32 that can be adjusted at either free end and is further stabilized by a glove and/or wrist stabilizer. Further, the user can increase core workout intensity by increasing the tension at the core resilient bands 38 and lower body resistance by increasing the tension of resilient bands 54.

It will be evident to one skilled in the art that a variety of changes can be made that are within the spirit and scope of the present invention. For instance, the flexible and ridged material can be replaced with only flexible material, or multiple adjustment points can be incorporated instead of only single tension adjustment mechanisms. Still further, tension adjustment mechanisms may be located at the knees or other joints to specifically target certain muscle groups. While the preferred embodiment fasteners are hook and loop style, any suitable fastener which is removably securable may be used without departing from the spirit and scope of the present invention.

Referring to FIGS. 9-15 there is shown a second embodiment of exercise suit in accordance with the present invention and generally indicated at 210. Suit 210 preferably is comprised of a separate shirt 212 and pants 214 but may instead be a unitary suit that substantially covers the entire body. Shirt 212 and pants 214 are substantially identical to shirt 12 and pants 14 except for the features that are described hereafter.

In accordance with a first feature of exercise suit 210, all of the resilient bands are disposed within elongate pockets located on shirt 212 and pants 214. Each pocket is formed by sewing or otherwise securing a strip of fabric to the interior surface of shirt 212 and pants 214 in such a manner that a hollow channel is formed between the layer of fabric and the interior surface of suit 10. The strip of fabric can be of any desired width but preferably will be around 1 inch wide. The resilient band is threaded through the channel and can be inserted and removed therefrom with relative ease.

Shirt 210 preferably is provided with a single pocket 215 therein. Pocket 215 extends from adjacent a left wrist region 217 of left sleeve 219, along a back region of left sleeve 219, across the rear side 221 of shirt 212, along a back region of right sleeve 223 to a position adjacent a right wrist region 225. A resilient band 232 is disposed within this pocket. Resilient band 232 is similar in nature to resilient band 32 and will therefore not be described in any additional detail herein.

Figure 13:
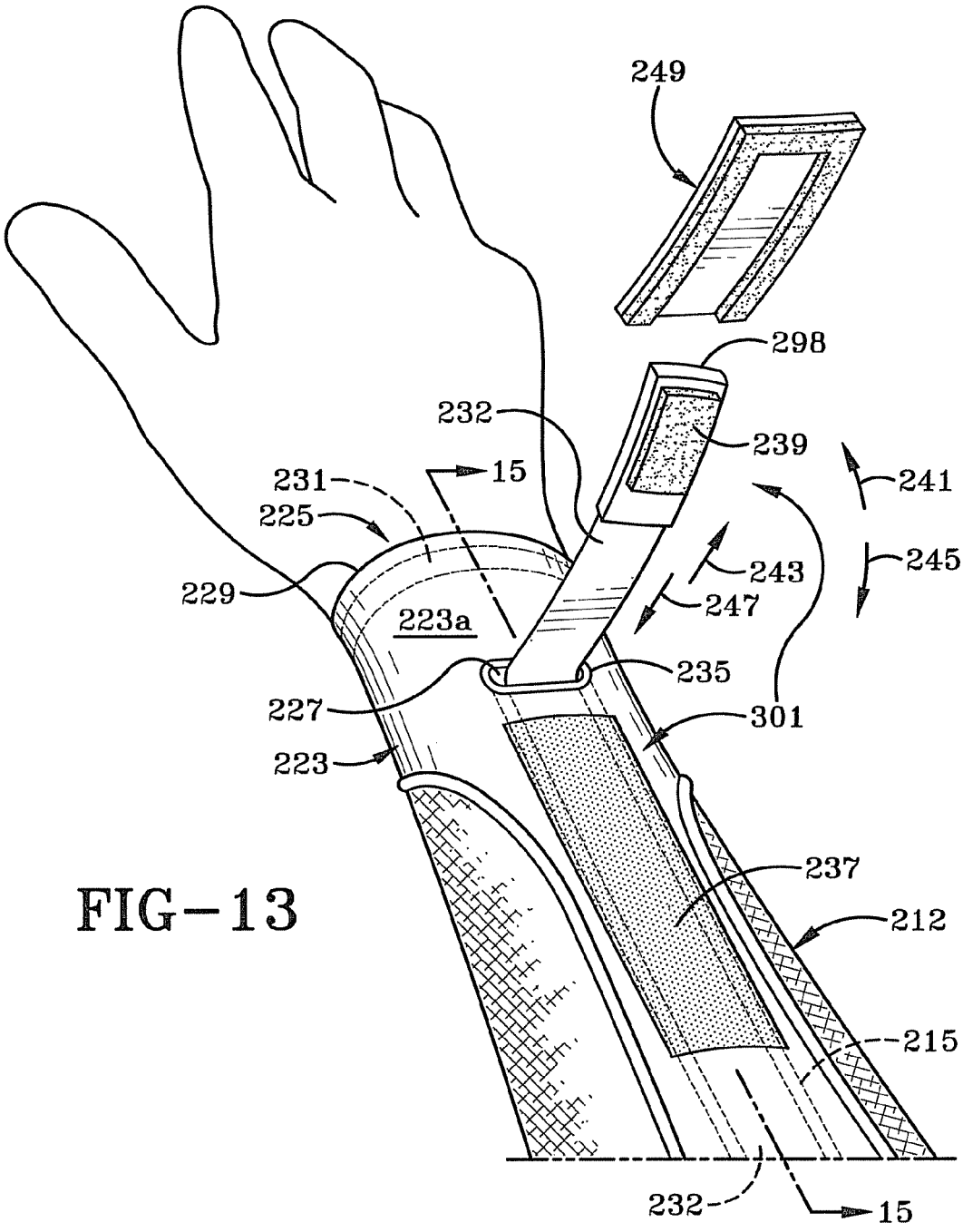
FIG. 13 is an enlarged top perspective view of a right sleeve of the suit shirt with the adjustment mechanism in a closed position and with the cover disposed thereof in a secured position.

Referring to FIG. 13, the features of exercise suit 210 at right wrist region 225 are shown in greater detail. It will be understood that left wrist region 217 is a mirror image hereof. In accordance with a specific feature of the present invention, a direction changing means is provided on suit 210. This direction changing means is an aperture 227 that is defined in right sleeve 223 a spaced distance from right wrist region 225. Preferably, aperture 227 is spaced between 1 and 2 inches away from the opening 229 therein. Aperture 227 extends between the interior surface 223*b* (FIG. 15) and exterior surface 223*a* of sleeve 223. Wrist region 225 may include a layer of tacky or gripping material 231 that aids in keeping right sleeve 223 generally fixed in position on the wearer's arm 233. Such gripping material 231 may include a silicone layer that is applied to the interior surface of the wrist region of the sleeves. Alternatively, wrist regions maybe provided with an elastic cuff that grips the wearer's wrists. (A similar gripping region may be provided on the ankle region of the pant legs.) Preferably, aperture 227 is surrounded by a reinforcement 235 that aids in preventing resilient band 232 from damaging the fabric of right sleeve 223. Resilient band 232 exits pocket 215 and is threaded through aperture 227 so that it passes from an interior region of right sleeve 223 to a region outside of the suit 210. As with resilient band 32, resilient band 232 is provided with a free end 298 that may include a housing 299 so that free end 298 may be easily grasped by the wearer.

In accordance with another feature of the present invention, suit 210 is provided with a tension adjustment mechanism 301 that is used to alter the tension in resilient band 232. Tension adjustment mechanism 301 comprises a first fastener component 237 and a second fastener component 239 that are configured to engage each other. First fastener component 237 comprises one of a hook and loop fastener that is secured to exterior surface 223*a* of right sleeve 223. Particularly, first fastener component 237 comprises an elongate strip of the one of the hook and loop fastener that extends for a distance along right sleeve 223 and substantially aligned with pocket 215 in the interior thereof. Second fastener component 239 comprises the other of a hook and loop fastener that is secured to free end 298 of resilient band 232. It should also be noted that first fastener component 237 is substantially longer and wider than is first fastener component 239.

Figure 14A:
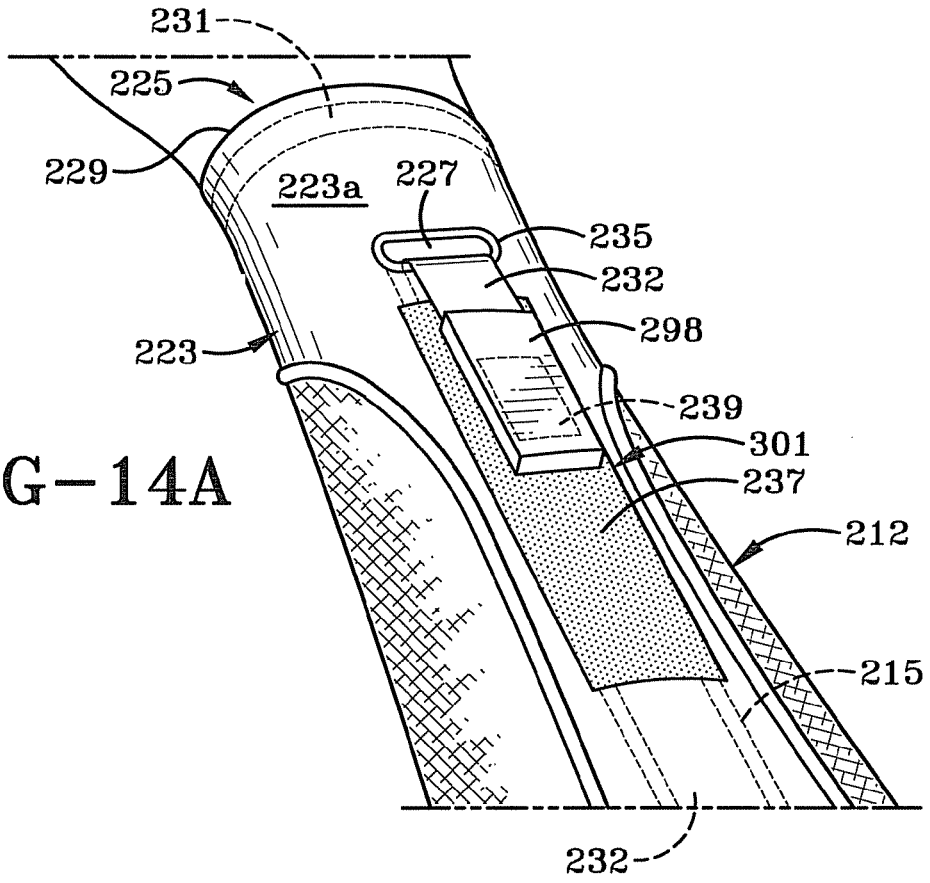
FIG. 14*a* is an enlarged top perspective view of the right sleeve of the suit shirt with the adjustment mechanism engaged in a first position.
Figure 14B:
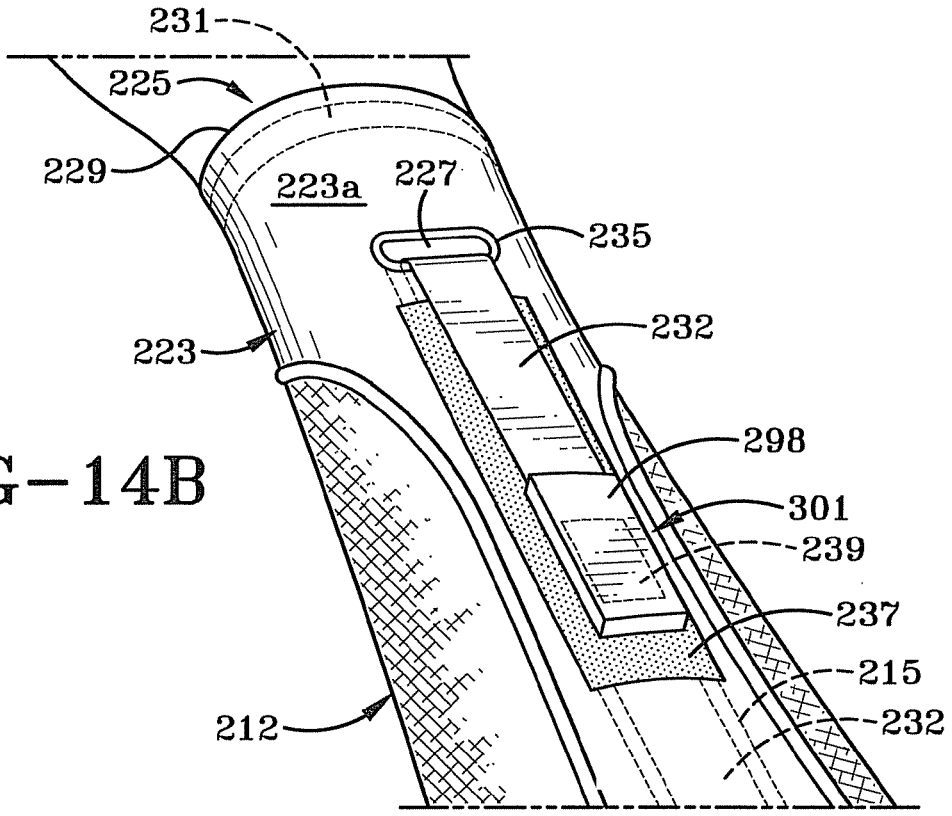
FIG. 14*b* is an enlarged top perspective view of the right sleeve of the suit shirt with the adjustment mechanism engaged in a second position.
Figure 15:
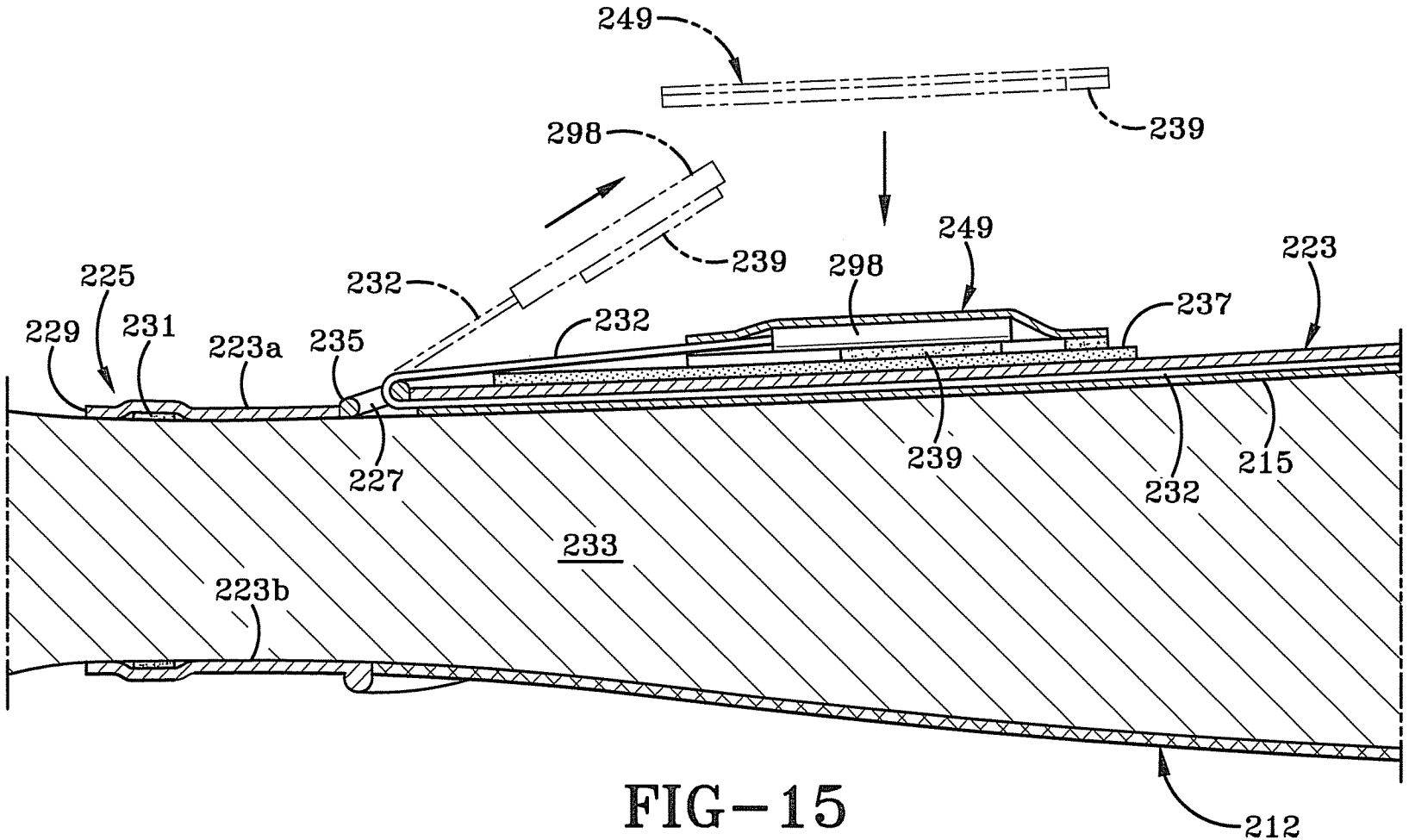
FIG. 15 is a cross-sectional left side view of the right sleeve of the suit shirt taken along line 15-15 of FIG. 13 and showing the sleeve resilient band in both an adjusted and a secured position.

FIGS. 13, 14*a* and 14*b* illustrate adjusting the tension in resilient band 232. Initially, free end 298 of resilient band 232 may be located in a first position on first fastener component 237, as shown in FIG. 14*a*. When the wearer wishes to adjust the tension in resilient band 232 they disengage second fastener component 239 from first fastener component 237 by pulling upwardly in the direction indicated by arrow 241 (FIG. 13). If they wish to increase tension in resilient band 232 they pull free end 298 of resilient band 232 outwardly in the direction indicated by arrow 243. Aperture 227 enables the user to apply leverage to resilient band 232 and thereby use less force to increase the tension therein than would otherwise be needed if the direction in band 232 was not changed. As the wearer pulls on band 232, an additional length thereof is drawn through aperture 227. When the desired tension is achieved in resilient band 232, the wearer moves free end 298 back toward first fastener component 237 in the direction indicated by arrow 245. Second fastener component 239 is then engaged with first fastener component in a second location that essentially causes that portion of the resilient band disposed between aperture 227 and free end 298 to lay substantially flat against a portion of the exterior surface of sleeve and first fastener component. Such a second location is illustrated in FIG. 14*b*.

If, on the other hand, the free end 298 was originally in this second location and the wearer wished to reduce tension in resilient band 232, they would disengage second fastener component 239 from first fastener component 237 by moving free end 298 in the direction indicated by arrow 241. That would then permit free end 298 to slide downwardly toward aperture 227 in the direction of arrow 247 under the spring action of resilient band 232. This motion would cause tension in resilient band 232 to be released. When the desired tension in resilient band 232 is achieved, the wearer will move free end 298 downwardly in the direction of arrow 245 and engage second fastener component 239 to first fastener component 237. In this instance, the new location of free end 298 will be closer to wrist region 225, such as the location represented in FIG. 14*a*. It will be understood that the wearer can position free end 298 anywhere along second fastener component 237 that achieves the desired tension in resilient band 232. It will further be understood that the left wrist region 217 includes a substantially identical tension adjustment mechanism and that resilient band 232 can therefore be adjusted at one or both wrist regions 217, 225.

In accordance with yet another feature of the present invention, exercise suit 210 is provided with a cover member 249 that is sized to engage first fastener component 237 when free end 298 of resilient band 232 is engaged therewith. Cover member 249 includes an interior surface that is provided with the same one of the hook and loop fastener as is provided on second fastener component 239. Cover member 249 is positioned over the engaged free end 298 and second fastener component 237 to protect the same and substantially prevent free end 298 from accidentally disengaging from second fastener component 237. A sudden disengagement of the same could potentially lead to the wearer accidentally injuring themselves because they are exerting a force sufficient to overcome the resistance provided by resilient band 232 and that force is suddenly no longer necessary. When the wearer wishes to adjust the tension in resilient band 232, cover member 249 is pulled free from engagement with first fastener component 237 by pulling it upwardly in the direction of arrow 241 (FIG. 13).

It will be understood, as was the case with previous tension adjustment mechanisms described with reference to exercise suit 10, tension adjustment mechanism 301 may be comprised of suitable connection members other that the hook and loop type fasteners illustrated and described therein. If the type of connection member is changed, cover member 249 would also include a different type of securement other than a hook and loop fastener. That different securement would be able to engage the selected style of first and second fastener components used in the suit 210. Alternatively, right sleeve 223 could be provided with a separate mechanism other than the first connection member 237 for engagement of cover member 249. So, for example, irrespective of the connection components selected for the first and second fastener components, cover member 249 could be configured to include hook and loop fasteners, snaps, zippers, ties etc that would mate with complementary components situated on exterior surface of right sleeve 223. All suitable variations in these component elements of exercise suit 210 are considered to fall within the scope of the present invention.

Pants 214 are shown in greater detail in FIGS. 9-12 and include a waist band region 251 which defines an opening for the wearer's waist and a pair of elongate tubular pant legs 253 and 255 that extend downwardly therefrom. Although not illustrated herein, waist region 251 preferably is provided with a mechanism for securing pants 214 about the wearer's waist and the mechanism may comprise one or more of a drawstring, elastic band, buttons, snaps, hook and loop fasteners or any other suitable components that cooperate to keep pants 214 on the wearer's body and, if necessary, anchored against movement during exercise.

Pant legs 253, 255 terminate in ankle regions 257, 259, respectively, each of which defines an opening through which the wearer will insert their feet. Each pant leg 253, 255 is provided with elongate pockets on its interior surface that are manufactured in the same manner as described with respect to pocket 215 in shirt 212. Both pant legs 253, 255 substantially identically constructed and are configured to be mirror images of each other.

In accordance with a feature of the present invention, each pant leg 253, 255 is provided with an elongate first pocket 261 that extends longitudinally from proximate the waist region 251 to proximate the respective ankle region 257, 259 on the interior surface of the legs. Each pant leg 253, 255 also includes a second pocket 263 that extends upwardly from proximate the respective ankle region 257, 259 for a distance to an area that will be disposed generally one third of the distance to mid-way between the wearer's ankle and knee. This area on pant legs 253, 255 is indicated by the number 265. Again, second pocket 263 is secured to the interior surface of the pant legs. First pocket 261 is positioned so that it is adjacent the outer side of the pant leg and second pocket 263 is positioned so that is adjacent the inner side of the pant leg. The outer side of pant leg 253, 255 will be disposed adjacent the outside of the wearer's leg and the inner side will be disposed adjacent the inside of the wearer's leg. In other words, neither of first and second pockets 261, 263 will be positioned along the front or the back of the wearer's knee.

In accordance with another specific feature of the present invention, a single resilient band 267 extends through first pocket 261 in one of pant legs 253, 355 from adjacent waist region 251 to the associated ankle region 257, 259, across the opening in the associated ankle region, and through pocket second 263 to area 265. A first aperture 269 is defined between a top end of pocket 261 and waist region 251 and a second aperture 271 is defined adjacent a top end of pocket 264. First and second apertures 269, 271 serve as direction changing means to alter the direction of resilient band 267. The fabric surrounding first and second apertures 269, 271 may be reinforced in a similar manner to the apertures 227 on shirt 212. Additionally, although not illustrated herein, a ring for aiding in altering the direction of the resilient band 267 may also be provided adjacent one or both of first and second apertures 269, 271. A first free end 273 of resilient band 267 exits pocket 261 in the interior of suit 310, extends through first aperture 269 and is thereby disposed on the outside of suit 310. A second free end 275 of resilient band 267 exits pocket 263 in the interior of suit 310, extends through second aperture 271 and is thereby disposed on the outside of suit 310.

In accordance with yet another specific feature of the present invention, a first and second tension adjustment mechanism 277, 279 is provided on the exterior surface of suit 310 to engage first and second free ends 273, 275, respectively. First and second tension adjustment mechanisms 277, 279 each comprise a first fastener component that is provided on the exterior surface of the suit and a second fastener component that is secured to the associated one of the first and second free ends 273, 275 of the resilient band 267. In each instance, the first fastener component comprises one of a hook and loop fastener 283 and the second fastener component comprises the other of the hook and loop fastener 281. The structure and functioning of these tension adjustment mechanisms 277, 279 is substantially identical to the structure and functioning of tension adjustment mechanisms 301 on sleeves 219, 223 and will therefore not be discussed further herein.

The positioning of the uppermost end of second pocket 263 is advantageous in that its placement makes it easy for the wearer to bend over and access free end 275 of resilient band 267. The position is much easier to reach than would be the case if the pocket extended above the knee or closer to the groin region. Additionally, the positioning of second pocket 263 gives the wearer and improved mechanical advantage when it comes to adjusting the band 267. It is easier for the wearer to apply some force from a position where they are bending down and then straightening up than it is to pull upwardly when in essentially a standing position.

Although not illustrated herein for the sake of clarity, it should be understood that all of the first and second tension adjustment mechanisms 277, 279 on pants 214 are provided with a cover member that is substantially identical in structure and function to cover member 249 described with reference to shirt 212.

Figure 11:
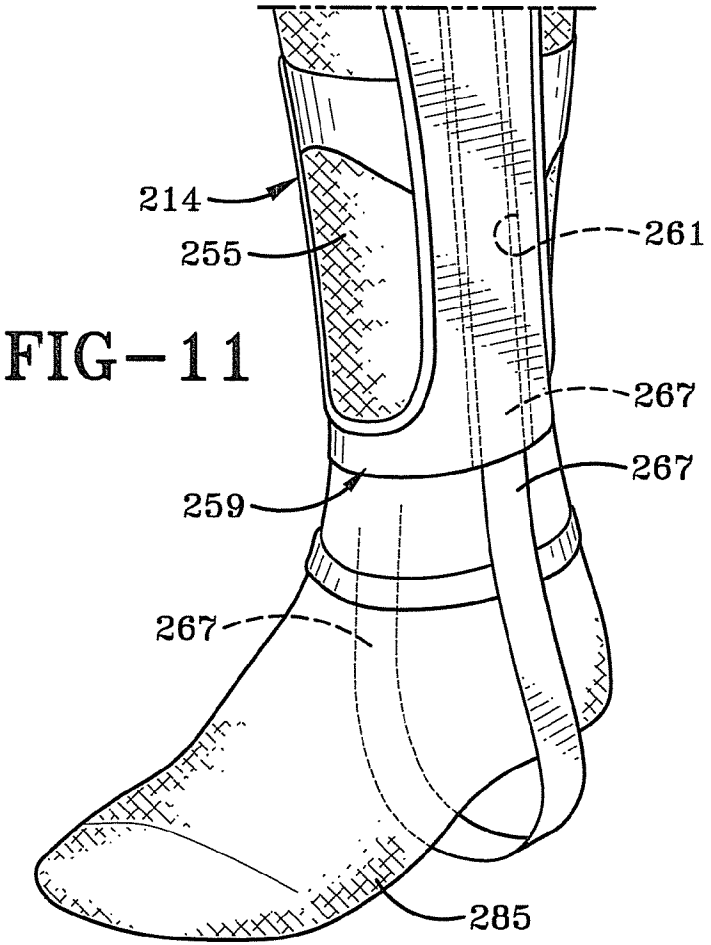
FIG. 11 is an enlarged left side perspective view of a bottom end of a left pant leg 56 of the exercise suit of FIG. 9 and showing the resilient band forming a foot stirrup and being positioned beneath a wearer's foot.

Referring to FIG. 11, it will be seen that each resilient band 267 is configured to extend for a distance beneath the opening to pant legs 253, 255 adjacent ankle regions 257, 259 thereof. Once the wearer has pulled the pants 214 on and inserted their feet through the openings adjacent ankle regions 257, 259, they will position each resilient band 267 against the arch in their foot 285 and then will adjust the tension in band 267 by engaging tension adjustment mechanism 279. Once the desired tension in resilient band 267 has been attained, the wearer can position a cover similar to cover 249 over tension adjustment mechanism 279 and then put on their shoe 287. After this initial adjustment, if the wearer wishes to adjust the tension in resilient band 267, is it relatively easy for them to adjust the same using tension adjustment mechanism 277 after removing the cover therefrom. This adjustment can be made even while exercising and does not require that the shoe 287 be removed. The cover will simply be replaced when the adjustment is completed.

It will be understood that while it has been disclosed herein that both of the free ends of the resilient bands utilized in suits 10 and 210 are adjustable, one of the free ends of each resilient band may be fixedly secured to the fabric of the suit and be non-adjustable without departing from the scope of the present invention.

Those of ordinary skill in the art will also appreciate that any one of the resilient bands that extend along the sleeve or leg of the suit can be situated so that it extends along the entire length of either an inner side or an outer side of the leg or sleeve, extends across the opening through which the foot or hand will extend and then extends along only a portion of the other of the inner side and outer side of the leg or sleeve. In this manner, the free end of the band that is adjustable is positioned so that it lies between the knee and ankle on the leg or between the hand and elbow on the arm. These locations make it relatively easy to adjust the tension in the band and the locations are accessible.

Although not illustrated herein, it should further be understood that while it has been disclosed that the direction changing means and the tension adjustment mechanisms are disposed so that they are generally aligned with the first direction of extension of the resilient bands, at least the tension adjustment mechanism could be positioned offset from the first direction of extension of the resilient band. The direction changing means would then be oriented to direct the band toward that offset tension adjustment mechanism and, in this instance, the aperture in the ring or in the fabric of the suit that serves as the direction changing means would most likely be oriented at an angle of other than 90° to the first direction of extension. Alternatively, if the direction changing means is the ring, it could be mounted to the suit in such a way that it swivels to permit the wearer to engage the free end of the resilient band with the tension adjustment mechanism in the offset location.

It should further be understood that while the exercise suit herein has been disclosed as having full-length sleeves and full length pant legs, it could instead be provided with one or both of shorter sleeves or shorter pant legs that are provided with tension adjusting mechanisms on the outermost regions of the shorter sleeves or pants. Additionally, the suit can comprise a shirt that is sleeveless with pants that have either full-length or shorter pant legs, or pants that have very short pants legs with a shirt that has either full length or shorter sleeves. The resilient bands provided on these different variations of the exercise suit can then include tension adjustment mechanisms on appropriate regions of the suit adjacent the outermost ends of the sleeves or pant legs. The bands themselves may extend beyond the outermost ends and around regions of the wearer's hands or feet if that is desired and then extend back toward the outermost ends of the sleeves or pant legs and be secured thereto in the manner described herein. Additionally, the resilient bands do not have to extend longitudinally along the sleeves or pant legs but can also be configured to helically wrap around the sleeves or pant legs.

Although not illustrated herein, it is also possible that the resilient bands used in sleeves and pant legs of the exercise suit be provided an anchoring region intermediate its free ends, where the anchoring region aids in securing a portion of the resilient band adjacent the elbows or the knees of the wearer. The resilient bands may also be of varying cross sectional shapes along their lengths. So, for example, the bands utilized in the pant legs may include enlarged resilient regions or split resilient regions that will be disposed so as to be positioned adjacent the user's knee to add support thereto. In this instance, a region of the band disposed adjacent the outer side of the pant legs and a region of the band disposed adjacent the inner side of the pant leg may be operationally connected to the region adjacent the wearer's knee.

It will also be understood that if the exercise suit is of a type that is unitary instead of a separate shirt and pants, at least some of the resistance bands may be positioned so that a first free end thereof is positioned on a shirt portion of the suit and the second free end thereof is positioned on a pants portion of the suit. Thus, the associated direction changing means and tension adjustment mechanism for the first free end of the resilient band is provided on the shirt portion and the associated direction changing means and tension adjustment mechanism for the second free end of the resilient band is provided on the pants portion of the suit.

It will also be understood that the direction changing means and the tension adjustment mechanism may be incorporated into a single component that is secured to at least one end of the resilient bands utilized in the exercise suit of the present invention. For example, a ratcheting type mechanism could be provided on the suit that will wind a length of the resilient band onto and off of a rotatable dial to increase or decrease the tension therein.

Still further, a number of other modifications may be made to the exercise suit and these modifications are considered to fall within the scope of the present invention. For example, the pant legs may be provided with a stirrup that is similar to the stirrups found in baseball pants and the resilient band can be threaded through a channel in the stirrup. Additionally, the guide pockets may include one or two additional layers of fabric that will be disposed in direct contact with the resilient band and these additional layers of fabric can be of a suitable friction-reducing type of material that permits the resilient band to slide easily within the guide pockets. Reflective material may be incorporated into the fabrics used to construct the exercise suit. So, for example, the guide pockets on the exterior of the suit could be constructed of a reflective material or such a material could be provided on the exterior surface of the guide pockets. Any piping provided on the suit could also be made from a reflective material. Furthermore, the exercise suit could be provided with an interior lining, especially in the waist region of the shirt, that includes or comprises a thermal-type of material that causes the user to sweat in the areas of their body that contact that material. The provision of a thermal-type lining around the waist region could aid the user in increasing their energy expenditure while wearing the suit, and specifically aid in reducing their waistline.

Accordingly, the exercise suit is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

Having now described the features discoveries, and principles of the invention, the manner in which the exercise suit is construed and used, the characteristics of the construction, and the advantageous new and useful results obtained; the new and useful structures, devices, elements, arrangement, parts, and combinations are set forth in the appended claims.

The invention claimed is:

1. An exercise suit comprising:

a front and a back adapted to cover a torso of a wearer;

a pair of first tubular members each of which extends outwardly from the front and back and terminates in one of a wrist region and an ankle region; each of said first tubular members being adapted to receive one of the wearer's arms and legs therethrough;

a pair of cuffs, each cuff being integrally formed with one of the first tubular members and covering a wrist or an ankle of the wearer;

a first resilient band extending in a first direction along one of the first tubular members, said first resilient band having a first free end and a second free end with an intermediate region therebetween;

a first direction changing means directly attached to the suit adjacent the cuff; and wherein a portion of the first resilient band that includes the first free end thereof, is engaged by the first direction changing means and is redirected to extend in a second direction; and a first tension adjustment mechanism, a part of the first tension adjustment mechanism being directly secured to the suit, and wherein the redirected first free end of the first resilient band is selectively engageable with the first tension adjustment mechanism; and wherein the part of the first tension adjustment mechanism anchors the first free end of the first resilient band to the suit; and the first tension adjustment mechanism is selectively activatable to adjust the tension in the first resilient band.

2. The exercise suit as defined in claim 1, wherein the first resilient band is slidable through the first direction changing means.

3. The exercise suit as defined in claim 1, wherein the first direction changing means comprises:

a ring member directly secured to an exterior surface of the suit; and an aperture defined in the ring member, and wherein said first resilient band extends through the aperture.

4. The exercise suit as defined in claim 1, wherein the first tension adjustment mechanism comprises:

a first fastener component engaged with the first free end of the first resilient band; and the part of the first tension adjustment mechanism comprises:

a second fastener component directly secured to an exterior surface of the one of the first tubular members.

5. The exercise suit as defined in claim 1, further comprising:

a first guide pocket provided on the one of the first tubular members;

a channel defined through said first guide pocket, said channel being oriented along the first direction of extension of the first resilient band; and wherein the first resilient band extends through said channel.

6. The exercise suit as defined in claim 5, further comprising:

a second direction changing means disposed proximate the second end of the one of the first tubular members and directly attached thereto; wherein a portion of said first resilient band including the second free end thereof engages the second direction changing means and extends there beyond in the first direction; and a second tension adjustment mechanism is disposed a distance inwardly from the second end of the one of the first tubular members and directly attached thereto, wherein a part of the second tension adjustment mechanism is secured directly to the one of the first tubular members; and wherein the second free end of the first resilient band releasably engages said second tension adjustment mechanism and anchors the second free end of the first resilient band to the suit; and the second tension adjustment mechanism is selectively activatable to adjust the tension in the first resilient band.

7. The exercise suit as defined in claim 6, further comprising a second guide pocket provided on the suit and spaced a distance from the first guide pocket, a second channel defined through said second guide pocket, said second channel being aligned with the channel in the first guide pocket, and wherein the first resilient band additionally extends through the second channel.

8. The exercise suit as defined in claim 1, wherein the first direction changing means comprises an aperture defined between an interior surface and an exterior surface of the one of the first tubular members, wherein the first tension adjustment mechanism is disposed on the exterior surface, and wherein the first resilient band is disposed adjacent the interior surface and extends through the aperture to engage the first tension adjustment mechanism.

9. The exercise suit as defined in claim 8, further comprising:

a first guide pocket secured to the interior surface of the suit; and a channel defined through said first guide pocket, said channel being oriented along the first direction of extension of the first resilient band; and wherein the first resilient band extends through said channel.

10. The exercise suit as defined in claim 9, wherein the first guide pocket extends from the first end of one of the first tubular members to a first end of the other of the first tubular members and the suit further comprises:

a second direction changing means secured directly to the first end of the other of the first tubular members; wherein said first resilient band engages the second direction changing means and at least a portion of the first resilient band extends there beyond in the first direction; and a second tension adjustment mechanism is secured directly to the suit a distance inwardly from the first end of the other of the first tubular members; and wherein the second free end of the first resilient band releasably engages said second tension adjustment mechanism.

11. The exercise suit as defined in claim 10, wherein the second direction changing means comprises a second aperture defined in other of the first tubular members adjacent the free end thereof, and wherein the first resilient band extends out of the first guide pocket and through the second aperture to engage the second tension adjustment mechanism.

12. The exercise suit as defined in claim 1, further comprising a cover member that is selectively engageable over the first tension adjustment mechanism.

13. The exercise suit as defined in claim 1, further comprising an anchoring means disposed adjacent the first end of the one of the first tubular members, said anchoring means adapted to secure the first end against movement along the one of the wearer's arms and legs during exercise.

14. The exercise suit as defined in claim 1, wherein the first tension adjustment mechanism includes at a least a first position and a second position, and wherein the first free end of the first resilient band is selectively engageable with the first tension adjustment mechanism in one or the other of the first and second positions, and when the first free end of the first resilient band is in the first position, the tension in the first resilient band is less than when the first free end of the first resilient band is in the second position.

15. The exercise suit as defined in claim 1, further comprising a pair of second tubular members each of which extends outwardly from the front and back of the suit and terminates at the cuff at the other of a wrist region and an ankle region of the suit; said second tubular members being adapted to receive the other of one of the wearer's arms and legs therethrough.

16. The exercise suit as defined in claim 15, further comprising:

a waist region disposed at a top end of the front and back; and wherein the second tubular members extend outwardly from a bottom end of the front and back; and wherein the first resilient band extends from proximate the waist region to the cuff at the ankle region of one of the second tubular members;

a second resilient band extends downwardly from proximate the waist region a spaced distance from the first resilient band, said second resilient band extending to the cuff at the ankle region of the other of the second tubular members;

a second direction changing means directly secured to the suit disposed proximate the cuff at the ankle region of the other of the second tubular members; wherein said second resilient band engages the second direction changing means and at least a portion of the second resilient band extends there beyond in a second direction; and a second tension adjustment mechanism disposed a distance inwardly from the ankle region of the other of the second tubular members; wherein a part of the second tension adjustment mechanism is directly secured to the other of the second tubular members; and wherein a first free end of the second resilient band is releasably engageable with said second tension adjustment mechanism.

17. The exercise suit as defined in claim 16, further comprising:

a third direction changing means directly secured to the suit proximate the waist region and positioned to be engaged by a second free end of the first resilient band;

a third tension adjustment mechanism directly secured to the suit a distance downwardly from the third direction changing means, wherein the second free end of the first resilient band is releasably engageable with said third tension adjustment mechanism;

a fourth direction changing means directly secured to the suit proximate the waist region and positioned to be engaged by a second free end of the second resilient band; and a fourth tension adjustment mechanism directly secured to the suit a distance downwardly from the fourth direction changing means, wherein a part of the fourth tension adjustment mechanism is secured to the waist region; and wherein the second free end of the second resilient band is releasably engageable with said fourth tension adjustment mechanism.

18. The exercise suit as defined in claim 1, wherein the first direction changing means and the first tension adjusting mechanism are both components of a single device that is directly secured to the suit and is engaged with the free end of the first resilient band.

19. The exercise suit as defined in claim 1, wherein the first free end of the first resilient band is detachably engaged with the first tension adjustment mechanism.

20. The exercise suit as defined in claim 6, wherein the second free end of the first resilient band is detachably engaged with the second tension adjustment mechanism.

* * * * *